US011266220B2

(12) United States Patent
Megaro et al.

(10) Patent No.: US 11,266,220 B2
(45) Date of Patent: Mar. 8, 2022

(54) APPARATUS AND METHOD FOR DISPENSING A FLUID

(71) Applicant: Blok Rok, Inc., Chapel Hill, NC (US)

(72) Inventors: Arianna Megaro, Charleston, SC (US); Matthew Megaro, Littleton, NC (US); Brad Forrest, Cary, NC (US)

(73) Assignee: BlokRok, Inc., Littleton, NC (US)

( * ) Notice: Subject to any disclaimer, the term of this patent is extended or adjusted under 35 U.S.C. 154(b) by 57 days.

(21) Appl. No.: 16/572,146

(22) Filed: Sep. 16, 2019

(65) Prior Publication Data

US 2020/0008558 A1 Jan. 9, 2020

Related U.S. Application Data

(63) Continuation of application No. 15/295,315, filed on Oct. 17, 2016, now Pat. No. 10,413,038, which is a (Continued)

(51) Int. Cl.
*A45D 34/04* (2006.01)
*B05B 11/00* (2006.01)

(Continued)

(52) U.S. Cl.
CPC ..... *A45D 34/041* (2013.01); *B05B 11/0037* (2013.01); *B05B 11/0038* (2018.08);

(Continued)

(58) Field of Classification Search
CPC ..... A45D 34/041; A45D 2200/055; A45D 2200/056; B05B 11/0037; B05B 11/0054;

(Continued)

(56) References Cited

U.S. PATENT DOCUMENTS 4,150,904 A 4/1979 Stewart
4,569,612 A 2/1986 Schwartzman et al.

(Continued)

FOREIGN PATENT DOCUMENTS

FR 2708314 A1 2/1995
WO 2015164242 A1 10/2015

OTHER PUBLICATIONS

Megaro , Arianna; Issue Notification for U.S. Appl. No. 14/257,507, filed Apr. 21, 2014, dated Sep. 28, 2016, 1 pg.

(Continued)

*Primary Examiner* — David J Walczak
(74) *Attorney, Agent, or Firm* — Taylor English Duma LLP

(57) ABSTRACT

A fluid transfer assembly comprises a housing for accommodating a fluid. A bellows member disposed in the housing defines an opening therethrough adapted to be in fluid communication with an applicator assembly. The bellows member is adapted to operatively engage the applicator assembly for extension in a first direction and contraction in a second direction. The bellows member seals against the inner surface of the housing during extension and contraction for defining a variable volume chamber with the housing. Expansion of the bellows member in the first direction reduces the chamber volume for generating positive pressure in the housing and forcing fluid through a valve to the applicator assembly. Contraction of the bellows member in the second direction increases the chamber volume for generating negative pressure within the housing for drawing fluid into the chamber.

9 Claims, 30 Drawing Sheets

Related U.S. Application Data continuation of application No. 14/257,507, filed on Apr. 21, 2014, now Pat. No. 9,468,279.

(51) Int. Cl.
*B05C 17/02* (2006.01)
*B05C 17/03* (2006.01)
*B05C 17/035* (2006.01)

(52) U.S. Cl.
CPC .... *B05B 11/0054* (2013.01); *B05B 11/00412* (2018.08); *B05B 11/3001* (2013.01); *B05B 11/3052* (2013.01); *B05B 11/3076* (2013.01); *B05C 17/0308* (2013.01); *B05C 17/0341* (2013.01); *B05C 17/0357* (2013.01); *A45D 2200/055* (2013.01); *A45D 2200/056* (2013.01)

(58) Field of Classification Search
CPC ..... B05B 11/00412; B05B 11/3001; B05B 11/3052; B05B 11/3076; B05B 11/0043; B05B 11/0038; B05C 17/0308; B05C 17/0341; B05C 17/0357
USPC ..... 401/208, 219–220, 152, 153, 156
See application file for complete search history.

(56) References Cited

U.S. PATENT DOCUMENTS

| | | | | |
|---|---|---|---|---|
| 4,669,637 | A | 6/1987 | Fiocco | |
| 4,723,860 | A * | 2/1988 | Giblin | A45D 34/041 401/206 |
| 4,812,071 | A | 3/1989 | Batra et al. | |
| 4,813,463 | A | 3/1989 | Lin | |
| 5,056,949 | A | 10/1991 | Petrillo | |
| 5,152,305 | A | 10/1992 | Niv | |
| 5,482,393 | A | 1/1996 | Sekiguchi et al. | |
| 5,516,223 | A | 5/1996 | Matz et al. | |
| 5,716,151 | A | 2/1998 | Satake | |
| 5,888,007 | A | 3/1999 | Nicoll et al. | |
| 5,899,624 | A | 5/1999 | Thompson | |
| 6,244,776 | B1 | 6/2001 | Wiley | |
| 6,406,207 | B1 | 6/2002 | Wiegner et al. | |
| 6,505,986 | B1 | 1/2003 | Oder | |
| 6,682,246 | B2 | 1/2004 | Reggiani | |
| 6,729,788 | B2 | 5/2004 | Bouveresse | |
| 6,883,996 | B2 | 4/2005 | Ishida | |
| 7,101,106 | B1 | 9/2006 | Wiley | |
| 7,226,231 | B2 | 6/2007 | Py et al. | |
| 7,658,568 | B1 | 2/2010 | Armstrong et al. | |
| 8,262,592 | B1 | 9/2012 | Brooks et al. | |
| 9,468,279 | B2 | 10/2016 | Megaro et al. | |
| 10,413,038 | B2 | 9/2019 | Megaro et al. | |
| 2005/0249540 | A1 | 11/2005 | Gueret | |
| 2008/0145136 | A1 | 6/2008 | Korper | |
| 2011/0250008 | A1 | 10/2011 | Lim | |
| 2012/0321368 | A1 | 12/2012 | Lim | |
| 2015/0296957 | A1 | 10/2015 | Megaro et al. | |
| 2017/0035180 | A1 | 2/2017 | Megaro et al. | |

OTHER PUBLICATIONS

Megaro, Arianna; Supplemental Notice of Allowance for U.S. Appl. No. 14/257,507, filed Apr. 21, 2014, dated Jun. 24, 2016, 4 pgs.
Megaro, Arianna; Non-Final Office Action for U.S. Appl. No. 14/257,507, filed Apr. 21, 2014, dated Dec. 7, 2015, 8 pgs.
Megaro, Arianna; Notice of Allowance for U.S. Appl. No. 14/257,507, filed Apr. 21, 2014, dated Jun. 15, 2016, 7 pgs.
Megaro, Arianna; Final Office Action for U.S. Appl. No. 15/295,315, filed Oct. 17, 2016, dated Jan. 14, 2019, 6 pgs.
Megaro, Arianna; Non-Final Office Action for U.S. Appl. No. 15/295,315, filed Oct. 17, 2016, dated Jun. 22, 2018, 8 pgs.
Megaro, Arianna; Notice of Allowance for U.S. Appl. No. 15/295,315, filed Oct. 17, 2016, dated May 9, 2019, 5 pgs.
Megaro, Arianna; International Preliminary Report on Patentability for serial No. PCT/US2015/026630, filed Apr. 20, 2015, dated Nov. 3, 2016, 11pgs.
Megaro, Arianna; International Search Report and Written Opinion for serial No. PCT/US2015/026630, filed Apr. 20, 2015, dated Jul. 23, 2015, 13 pgs.
Megaro, Arianna; Office Action of Australia for serial No. 2015250064, filed Apr. 20, 2015 dated Dec. 21, 2018, 3 pgs.

* cited by examiner

APPARATUS AND METHOD FOR DISPENSING A FLUID

CROSS-REFERENCES

This application is a continuation application of U.S. patent application Ser. No. 15/295,315, filed Oct. 17, 2016, now U.S. Pat. No. 10,413,038, which is a continuation of U.S. patent application Ser. No. 14/257,507, filed Apr. 21, 2014, now U.S. Pat. No. 9,468,279, the contents of all are incorporated herein by reference.

BACKGROUND

An apparatus and method for dispensing fluid is described and, more particularly, an apparatus and method for dispensing fluid on the skin.

Conventional hand held and manipulated fluid applicators for dispensing a lotion on the skin are numerous. In some applicators, a lotion supply mechanism is provided to deliver the lotion from a fluid storage container to the applicator that makes contact with the skin. In one embodiment, applicators have a squeezable fluid storage container connected to a roller-mounting applicator head which meters fluid from the container to a fluid absorbent dispensing roller or pad made of felt or other porous resilient material. This configuration is limited, however, to use with less viscous fluids, which are capable of passing through a porous member and are believed to be less well suited for applying more viscous fluids, such as sunscreen. Also, many applicators require the consumer to squeeze the entire volume of the container each time a small amount of fluid is desired while others require a repetitive and uncomfortable pumping to transfer fluid making such mechanisms tedious and uncomfortable to operate. Further, these applicators cannot be operated in an inverted position due to the need to maintain contact between the fluid and the supply mechanism. This inversion makes the applicator awkward and difficult in reaching certain areas of the body. In the case of conventional bottled lotion containers, these generally require the consumer to first pour fluid onto their palms and then spread the fluid onto their skin, a process that can be both tedious and messy and make it difficult to apply uniform layers of lotion. Finally, aerosol spray devices are used to deliver some lotions but these add cost and disposable waste while introducing the mess of overspray, the flammability danger of alcohol-based propellants, the inhalation risk of aerosolized micro particles and the inability to deliver more viscous skin protecting emollients.

For the foregoing reasons, there is a need for a new apparatus and method for dispensing a fluid. The new apparatus and method should provide fluid application to the skin in a faster, less messy, and more effective manner than conventional fluid delivery applicators.

SUMMARY

An apparatus for dispensing a fluid is described. The fluid dispensing apparatus comprises a housing defining an interior and a resilient liner adapted to hold the fluid, the liner configured to be at least partially disposed in the interior of the housing. An applicator assembly is provided for dispensing the fluid on a surface, the applicator assembly mounted on the housing. The applicator assembly includes an actuator movable relative to the housing in a first direction and a second direction, and a fluid delivery element which is held in contact against the surface for applying the fluid onto the surface. The fluid delivery element is supported on the actuator to be movable together with the actuator by varying contact pressure with the surface. A pump assembly is at least partially disposed in the housing. The pump assembly comprises a pump chamber having an inner surface defining an interior cavity for accommodating fluid. The pump chamber is configured to be in fluid communication with the liner and have at least one inlet opening for receiving the fluid. A bellows member defining an opening therethrough is in fluid communication with the applicator assembly. The bellows member operatively engages the actuator of the applicator assembly and is disposed in the pump chamber for extension in the first direction and contraction in the second direction. The bellows member seals against the inner surface of the pump chamber during extension and contraction for defining a variable volume chamber with the pump chamber. A valve is at an outlet end of the opening through the bellows member. Each movement of the actuator in the first direction reduces the volume of the variable volume chamber for generating positive pressure in the pump chamber and forcing fluid through the valve and to the applicator assembly for dispensing the fluid. Each movement of the actuator in the second direction increases the volume of the variable volume chamber and generates negative pressure within the pump chamber for drawing fluid through the at least one inlet opening in the pump chamber.

A fluid transfer assembly for use with an apparatus for dispensing a fluid is also described. The fluid dispensing apparatus includes a source of fluid and a reciprocating applicator assembly for dispensing the fluid on a surface. The fluid transfer assembly comprises a housing having an inner surface defining an interior cavity for accommodating the fluid. The housing is adapted to be in fluid communication with the source of fluid and have at least one opening for receiving the fluid. A bellows member defines an opening therethrough adapted to be in fluid communication with the applicator assembly. The bellows member is adapted to operatively engage the applicator assembly and is disposed in the housing for extension in a first direction and contraction in a second direction. The bellows member seals against the inner surface of the housing during extension and contraction for defining a variable volume chamber with the housing. A valve is at an outlet end of the opening through the bellows member. Expansion of the bellows member in the first direction reduces the volume of the variable volume chamber for generating positive pressure in the housing and forcing fluid through the valve and to the applicator assembly. Contraction of the bellows member in the second direction increases the volume of the variable volume chamber for generating negative pressure within the housing for drawing fluid into the chamber through the at least one opening in the housing.

Further, a method for dispensing a fluid comprises step providing a fluid dispensing apparatus, including a housing defining an interior and a resilient liner adapted to hold the fluid, the liner configured to be at least partially disposed in the interior of the housing. An applicator assembly is provided for dispensing the fluid on a surface, the applicator assembly mounted on the housing. The applicator assembly includes an actuator movable relative to the housing in a first direction and a second direction, and a fluid delivery element which is held in contact against the surface for applying the fluid onto the surface. The fluid delivery element is supported on the actuator to be movable together with the actuator by varying contact pressure with the surface. A pump assembly is at least partially disposed in the housing.

The pump assembly comprises a pump chamber having an inner surface defining an interior cavity for accommodating fluid. The pump chamber is configured to be in fluid communication with the liner and have at least one inlet opening for receiving the fluid. A bellows member defining an opening therethrough is in fluid communication with the applicator assembly. The bellows member operatively engages the actuator of the applicator assembly and is disposed in the pump chamber for extension in the first direction and contraction in the second direction. The bellows member seals against the inner surface of the pump chamber during extension and contraction for defining a variable volume chamber with the pump chamber. A valve is at an outlet end of the opening through the bellows member. The method further comprises the steps of contacting the surface with the fluid delivery element, pressing the fluid delivery element against the surface for moving the actuator in the first direction and reducing the volume of the variable volume chamber for generating positive pressure in the pump chamber and forcing fluid through the valve and to the applicator assembly for dispensing the fluid, and releasing pressure of the fluid delivery element from the surface for allowing the actuator to move in the second direction for increasing the volume of the variable volume chamber and generating negative pressure within the pump chamber for drawing fluid through the at least one inlet opening in the pump chamber.

BRIEF DESCRIPTION OF THE DRAWINGS

For a more complete understanding of the present invention, reference should now be had to the embodiments shown in the accompanying drawings and described below. In the drawings:

FIG. 2 is an exploded perspective view of the fluid dispensing apparatus as shown in

FIG. 1.

FIG. 15 is a transverse cross-section of the fluid dispensing apparatus as shown in

FIG. 13.

FIG. 21 is an exploded perspective view of the fluid dispensing apparatus as shown in

FIG. 20.

FIG. 31 is a transverse cross-section of the fluid dispensing apparatus as shown in

FIG. 29.

FIG. 32 is a transverse cross-section of the fluid dispensing apparatus as shown in

FIG. 30.

DESCRIPTION

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGS. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Figure 1:
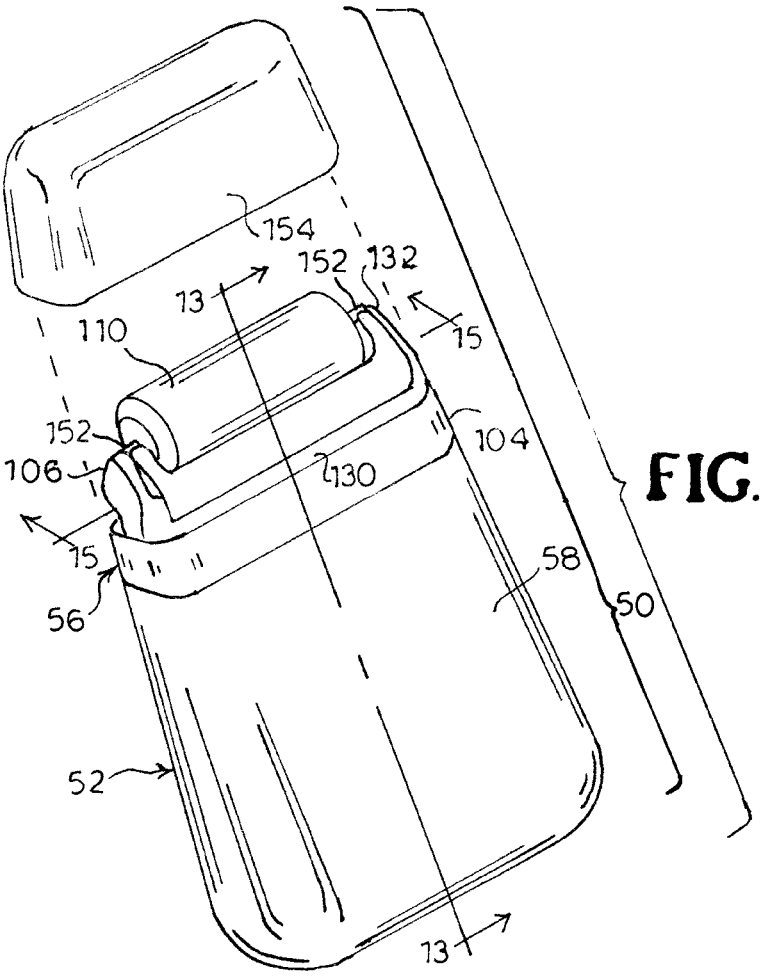
FIG. 1 is a perspective view of an embodiment of an apparatus for dispensing fluid.
Figure 2:
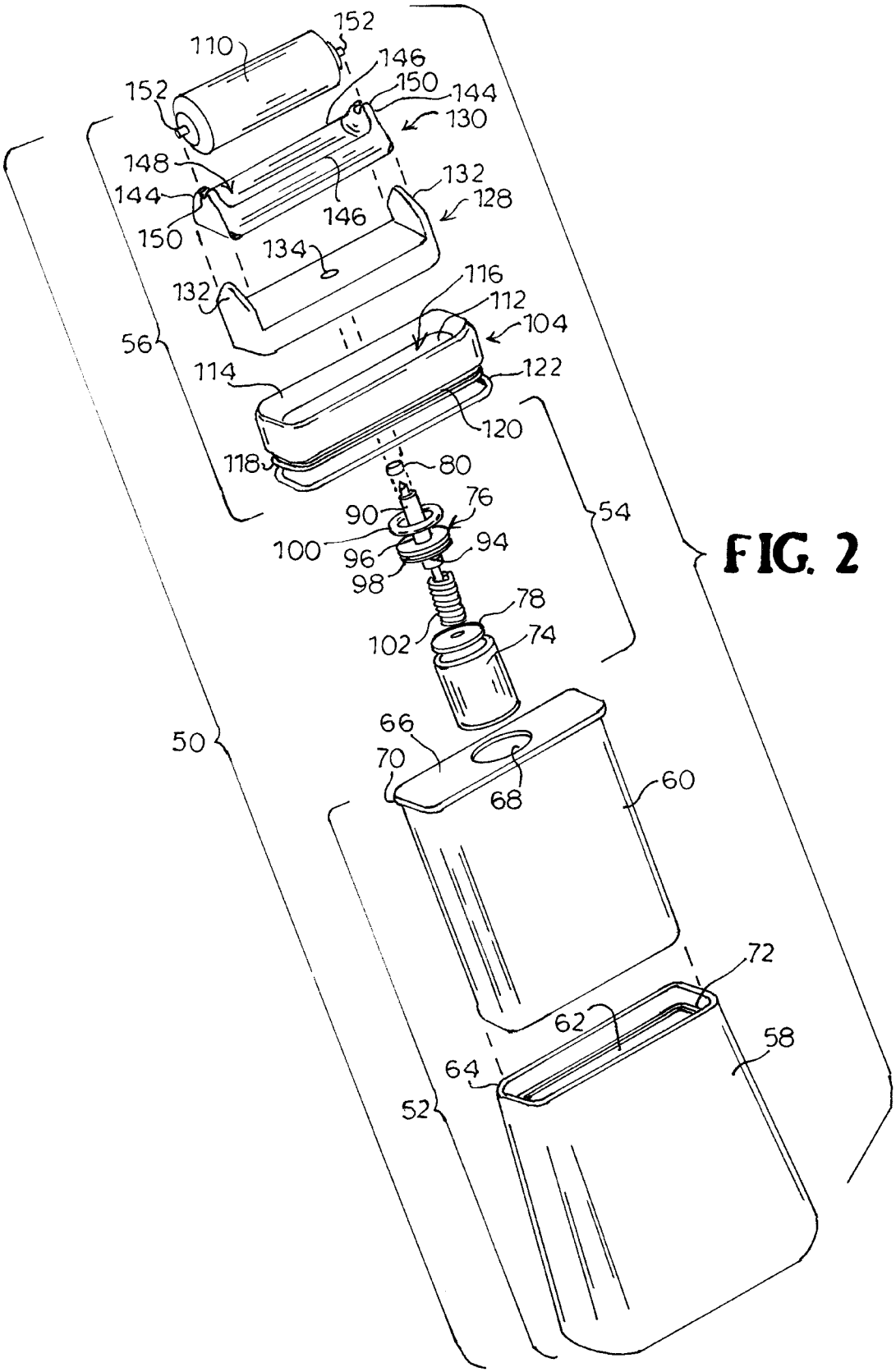

Referring now to the drawings, wherein like reference numerals designate corresponding or similar elements throughout the several views, an apparatus for dispensing a fluid is shown in FIGS. 1 and 2 and generally designated at 50. The fluid dispensing apparatus 50 is a hand-held dispenser comprising a reservoir assembly 52 for accommodating a fluid, a pump assembly 54 in fluid communication with the reservoir assembly, and an applicator assembly 56 in fluid communication with the pump assembly for applying the fluid on a surface, such as skin of a human body.

The reservoir assembly 52 comprises a housing 58 and a liner 60 for the housing. The housing 58 is a substantially hollow member defining an interior cavity 62 having an open outer end 64. As shown in FIGS. 1 and 2, the housing 58 may be a trapezoid shape. It is understood, however, that the housing 58 can be any geometric shape, including, for example, square, rectangular, oval, circular, conical, cylindrical and combinations and variations of these, including irregular patterns. The shape of the housing 58 may be selected based on considerations of ergonomics, performance, cost of production, safety and security. The shape of the housing 58 should also consider ease of fabrication, for example, by various methods from plastic and metal. In the present embodiment, the trapezoid shape has sides that taper inwardly toward the outer end 64 of the housing 58. This configuration offers a natural grip for stability in the hand of a user. The exterior edges of the housing 58 may be rounded such that the housing fits comfortably and securely in the palm of the hand. Various contouring is also contemplated to enhance user performance.

The dimensions of the housing 58 may vary depending on desired fluid volume to be contained within the housing, as well as certain desired performance attributes. For example, a larger, longer housing 58 may extend the reach of a user during use, whereas a smaller housing will reduce the contained fluid volume, but enable easy storage, such as in a pocket.

The housing 58 may be formed from rigid or semi-rigid polymers, including, but not limited to, delrin, Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. In some embodiments, the housing 58 may comprise metal, such as die cast metal, or have metal inserts to increase the strength of the housing. The preferred thickness of the material of the housing 58 should be sufficient to withstand impact on a hard surface when dropped and will depend on the material itself. It is understood that the housing 58 is not intended to be limited by the materials listed here, but may be carried out using any suitable synthetic or natural material which allows the construction and use of the apparatus described herein and sufficient to meet strength, weight, and other desired characteristics.

The exterior surface of the housing 58 may be designed to enhance appearance and performance. For example, a textured exterior surface can aid the user in gripping the housing 58, especially if fluid is on the exterior surface or the hand. Further, the exterior surface may be designed to enhance gripping during the operation of not only squeezing but also pressing the container's applicator assembly against the surface on which the liquid is to be applied. Accordingly, the exterior surface of the housing 58 may have features to enhance grip and to aid in control of the housing during fluid application, including, but not limited to, dimples, indentations, finger grips, slots, channels, protrusions, ridges, bumps, and the like, or any combination thereof. The features of the exterior surface of the housing 58 may be formed of materials desirable to the intended use, including requirements of durability, washability, UV resistance, water and heat resistance and impact resistance. Still further exterior features include camouflage for military and hunting applications or the addition of an elastomer or rubber to enhance the gripping capability. As shown in FIG. 1, the housing 58 may also have a slot or other anchoring point to permit the attachment of a carrying lanyard.

In another embodiment, the housing 58 may be a disposable container made in a known manner of a pliant injection molded plastic material such that fluid may be dispensed by manually squeezing, and thus compressing, the side walls of housing. In still another embodiment, the housing 58 may be made of a clear or partially transparent material that will provide the means to visually ascertain the level of fluid remaining in the liner 60.

The liner 60 is a flexible, resilient pouch for holding the fluid to be dispensed. The liner 60 has a top wall 66 defining a circular opening 68 into the interior of the pouch. The liner 60 is adapted to be received within the cavity 62 of the housing 58 such that the liner is at least partially disposed within the housing. As seen in FIG. 2, the liner 60 can be provided with a flange 70 extending outwardly from the periphery of the top wall 66. The outer end 64 of the housing 58 has a shoulder 72 formed along the inside of the edge of the housing 58 for receiving the flange 70 of the liner 60.

A particular performance attribute of the liner 60 is that it collapses as it is depleted of fluid, without permitting air to fill the void created by the depleted fluid. This attribute enables the fluid in the liner to remain in constant contact with the pressurization chamber, irrespective of the relative position of the applicator during use. Accordingly, the applicator will operate at any angle of use, a particularly useful feature for applying sunscreen or other fluids to surfaces that are above the level of the user's hand as the user holds the applicator during use.

Still another attribute of the liner 60 is that it enables the transfer of fluid by responding to a relative vacuum generated by the pump assembly 54. Accordingly, the liner 60 does not need to be under positive pressure and has neutral pressure while not in use, reducing the risk of fluid leakage at seams, holes or other opening that are in contact with the liner, such as the point of connection between the housing 58 and the applicator assembly 56.

In one embodiment, the liner 60 is sized and shaped to fit snugly within the housing 58. The interior of the housing 58 is shaped to retain the liner 60 and limit slippage and bunching of the liner, which may include beveled corners and other irregular forms that can better hold the liner in position during use and refilling. The flexibility and resiliency of the material of the liner 60 allows the liner to conform to the interior of the housing 58 to maximize the amount of fluid that can be stored within the housing. The interior of the housing 58 may further comprise a textured surface or added lubrication to assist in the placement and removal of the liner 60, or to allow the liner to change shape in reaction to the addition or removal of fluid.

In another embodiment, the liner 60 may have the additional feature of a second opening that permits the liner to be refilled through a separate portal passing through the exterior housing and without having to remove the applicator assembly 56. This additional portal may be formed with a threaded plug, or other sealable closure elements, that permits for the portal to be readily opened and closed from the exterior of the housing 58.

In another embodiment, the liner 60 may have lateral creases or accordion folds (not shown) that enable the liner to collapse beginning at one end of the liner, preferably the end distal to the pump assembly 54, until it is fully depleted. This operation will provide a visual indication to the user as to the degree to which the liner 60 is depleted and thus the amount of fluid remaining.

The material of the liner 60 may be clear or translucent, which will enable the user to determine the amount of fluid in the liner during use or filling. It is understood that in this embodiment, the housing 58 may also be formed from transparent or translucent material. In another embodiment, the material of the liner 60 may be opaque or of a composition that shields the contents from UV light for use, for example, with photosensitive fluids such as, for example, sunscreen. The liner color, along with symbols, logos, and other markings (not shown), will also enable the user to readily identify the specific contents of a given liner 60 without foreknowledge of its contents and without removing the liner from the applicator The liner 60 is removable for cleaning, refilling or replacement. The user can also fill the liner 60 while the liner is in the housing 58. In this method, the housing 58 provides rigidity and stability to the liner 60 during filling. An indicator (not shown) may be provided on the liner 60 to identify a maximum fill level to reduce spills during filling.

In another embodiment, prefilled liners may also be provided for replacement of a spent liner 60. A prefilled liner would permit branding and labeling of the fluid such that the user would know the content of the liner. Prefilled liners could then be sold separately as a disposable item. A prefilled liner would incorporate a sealing method that allows the user to quickly peel off a seal before replacing the liner, or the liner 60 may incorporate a membrane seal that is punctured during insertion, thereby accessing the fluid for use. Prefilled liners 60 would have features that secure the liner, align it within the housing 58 and allow it to form a seal.

The pump assembly 54 provides a means for drawing fluid from the reservoir assembly 52 and delivering the fluid to the applicator assembly 56 for dispensing the fluid. The pump assembly 54 comprises a pressurization chamber 74 for temporarily storing fluid received from the reservoir assembly 52, a piston member 76, an inlet valve 78 for permitting fluid to be drawn into the pressurization chamber 74 from the reservoir assembly 52, and an outlet valve 80 permitting the fluid to be delivered from the pressurization chamber 74 to the applicator assembly 56. As described herein below, the pump assembly 54 is actuated for drawing fluid from the reservoir assembly 52, pressurizing the fluid within the pressurization chamber 74, and delivering the fluid to the applicator assembly 56.

Figure 3:
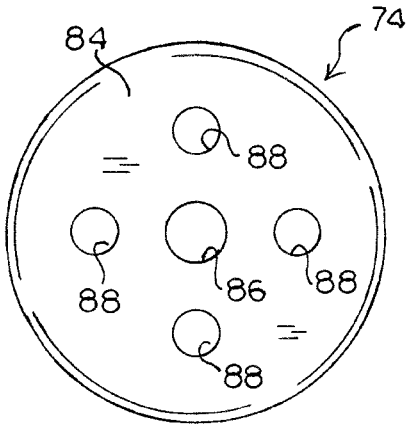
FIG. 3 is a transverse cross-section view of an embodiment of a pressurization chamber for use in the fluid dispensing apparatus as shown in FIG. 1.
Figure 12B:
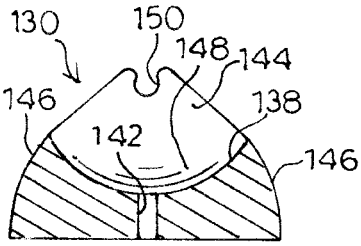
FIG. 12B is a transverse cross-section view of the tray member as shown in FIG. 10.

The pressurization chamber 74 is a hollow, cylindrical tube defining an interior chamber 82 closed at an inner end 84. As seen in FIG. 3, the closed inner end 84 of the pressurization chamber 74 defines a central axial opening 86 and a plurality of fluid intake ports 88 radially spaced from the central axial opening. The intake ports may be disposed symmetrically around the central axial opening 86. The pressurization chamber 74 is sized and shaped based on the space limitations of the reservoir assembly 52 and the desired amount of fluid to be discharged in a single activation of the applicator. The embodiment of the pressurization chamber 74 shown in the FIGS. is just one example, and it is understood that the pressurization chamber may be configured in any suitable shape. The interior chamber 82 of the pressurization chamber 74 is adapted to meet preferred fluid delivery volume requirements or other performance needs. A larger chamber 82 will require a higher positive pressure input for actuation by the user and will reduce the relative fluid storage capacity of the reservoir assembly 52. A smaller chamber 82 will deliver less fluid per actuation, but will require less actuation pressure, a desirable feature for some applications where less applicator pressure on the application surface is conducive to operator control and comfort. For example, a chamber volume of 0.066 oz. delivers a sufficient fluid volume of 0.033 oz. The pressurization chamber 74 is readily modifiable to transfer larger or smaller fluid volumes. The configuration of the pressurization chamber 74 delivers lotions with viscosities typical for a range of hand applied sunscreens, lotions, balms, and other skin care products. The pressurization chamber dimensions, fluid transfer ports, valve flow rates and springs may be modified to be adapted to other fluids with greater or lesser relative viscosity.

The piston member 76 is an elongated rod having an inner portion 89 and a hollow outer portion 90 open at an outer end 91. The piston member 76 has at least one port 94 opening into the interior of the outer portion 90. A circular piston head 96 extends normally from the perimeter of the piston member 76 intermediate its length. The diameter of the piston head 96 corresponds to the diameter of the interior of the pressurization chamber 74. The piston head 96 may have a circumferential groove 98 for receiving an o-ring 100 for sealing engagement of the piston head against the wall of the pressurization chamber 74. Alternatively, the piston head 96 may be of sufficiently accurate tolerance to form a seal to the inner wall of the pressurization chamber 74

The piston head 96 may have a flat surface or may have a concave or convex surface. The piston member 76 is at least partially disposed in the pressurization chamber 74. In a home position of the piston member 76, the inner portion 89 extends at least partially into the central axial opening 86 in the inner end 84 of the pressurization chamber 74. A circular stop valve 78 is disposed at the inner end of the pressurization chamber 74 and defines a central opening for passing the inner portion 89 of the piston member 76. The diameter of the stop valve 78 is the same as the interior diameter of the pressurization chamber 74. The stop valve 78 is in sealing contact with the bottom wall of the pressurization chamber 74 such that a fluid path from the liner 60 via the intake ports 88 is normally closed by the stop valve 78. The piston member 76 is biased outwardly toward the home position by means of a coil spring 102 interposed between the piston head 96 and the bottom wall of the pressurization chamber 74. The spring 102 also serves to hold the stop valve 78 in place. It is understood that other loading springs may be suitable for the fluid dispensing apparatus 50, such as leaf, volute, or torsion springs. The inner portion 89 of the piston member 76 is sized so that the piston member can reciprocate axially relative to the pressurization chamber 74 and the stop valve 78 when the pump assembly 54 is actuated. Axial movement of the piston member 76 is guided by confined movement of the inner portion 89 in the central axial opening 86. This arrangement increases the stability of the mechanism of the pump assembly 54 during use.

A one-way valve 80 is provided at the outer end 91 of piston member 76. In the embodiment shown in FIGS. 1 and 2, the one-way valve 80 is a duckbill valve. A press fit collar or a molded undercut holds the duckbill valve 80 in position on the piston member 76. The flat end of the duckbill valve 80 is configured to open in response to positive pressure in the pressurization chamber 74 allowing fluid to pass from the pressurization chamber. When pressure is removed, or there is negative pressure in the pressurization chamber 74, the duckbill valve 80 closes preventing fluid backflow, including air, from entering the pressurization chamber 74. It is understood that other one-way valves may be suitable for use in the fluid dispensing apparatus 50, including, but not limited to, ball check valves, umbrella valves, swing check valves or tilting disc check valves, stop-check valves, lift-check valves and the like.

The applicator assembly 56 comprises various components that are integrated to enhance the rapid delivery of large liquid volumes. In this regard, the applicator assembly 56 receives fluid, distributes it into position for uptake on the applicator head, minimizes excessive fluid flow that may lead to leaks and spills, applies a uniform coating of liquid while at the same time enables the transfer of pressure that enables the operation of the pressurization chamber. In particular, the applicator assembly 56 performs these operations while enabling the user to regulate variably the rate at which fluid is delivered to the application surface by varying the amount of pressure applied to the applicator on the delivery surface. Notably, the user may choose to apply little pressure so as to stop the flow of liquid, as may be desirable in instances where the user wishes to operate the applicator on the application surface to manage the liquid that is already applied, without delivering additional fluid at that moment.

Figure 4:
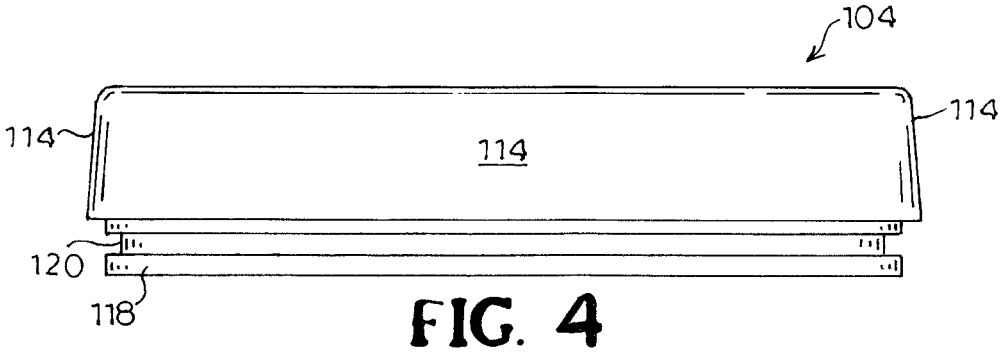
FIG. 4 is an elevation view of an embodiment of a top plate for use in the fluid dispensing apparatus as shown in FIG. 1.
Figure 5A:
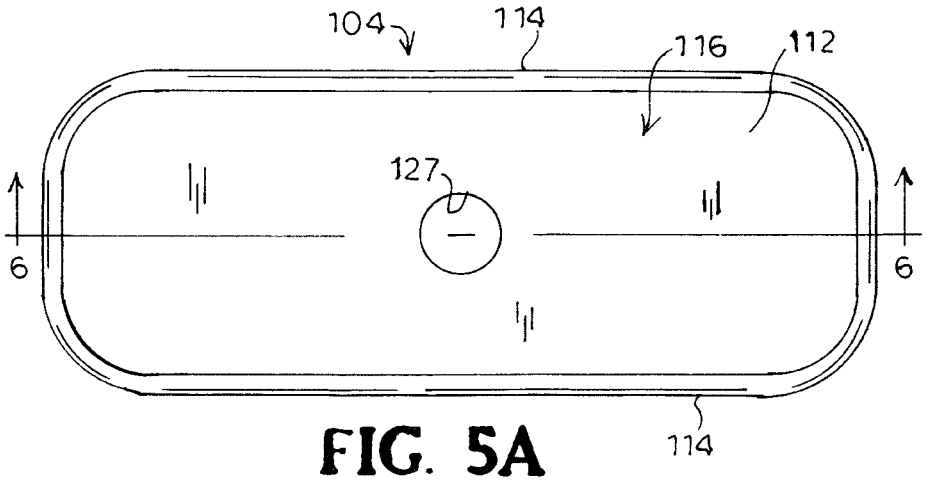
FIG. 5A is a top plan view of the top plate as shown in FIG. 4.
Figure 5B:
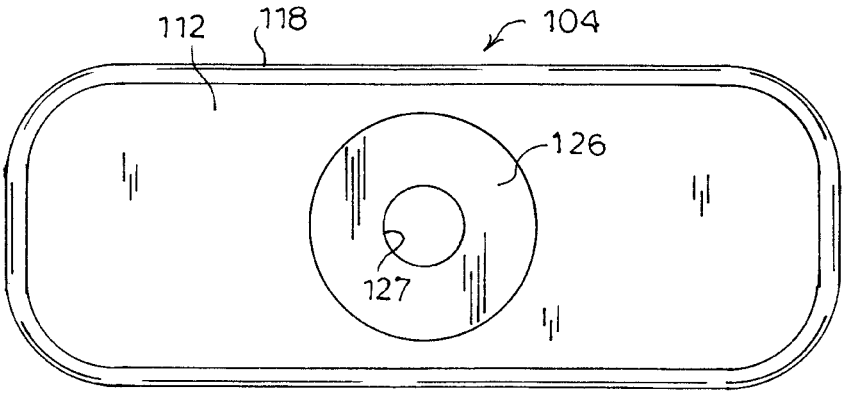
FIG. 5B is a bottom plan view of the top plate as shown in FIG. 4.

The applicator assembly 56 comprises a top plate 104, a fluid upload tray 106 and a roller head assembly 108, including a roller 110. The applicator assembly 56 receives and transmits fluid from the pump assembly 54 to the roller 110. Referring to FIGS. 4-5B, the top plate 104 includes a base member 112 and integral peripheral walls 114 extending outwardly from the base member. The base member 112 and peripheral walls 114 define a cavity 116 for slidingly receiving the upload tray 106 for reciprocation of the upload tray with respect to the top plate 104. The top plate 104 has a flange 118 depending inwardly from the base member 112. The outer surface of the flange 118 defines a peripheral groove 120 for receiving a ring seal 122. The ring seal 122 can be, for example, an O-ring or a quad-ring which provides extra sealing force. The top plate 104 fits snugly onto the housing 58 with the flange 118 received in the outer end 64 of the housing. The ring seal 122 on the exterior of the flange 118 provides sealing engagement with the inner surface of the housing 58. As seen in the FIGS. 13 and 14, the top plate 104 captures the flange 70 of the liner 60 against the shoulder 72 at the outer end of the housing 58.

Figure 6:
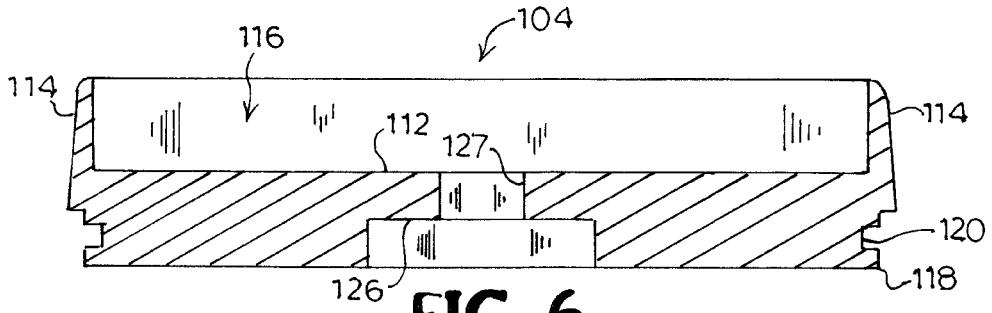
FIG. 6 is a longitudinal cross-section view of the top plate as shown in FIG. 4.
Figure 7:
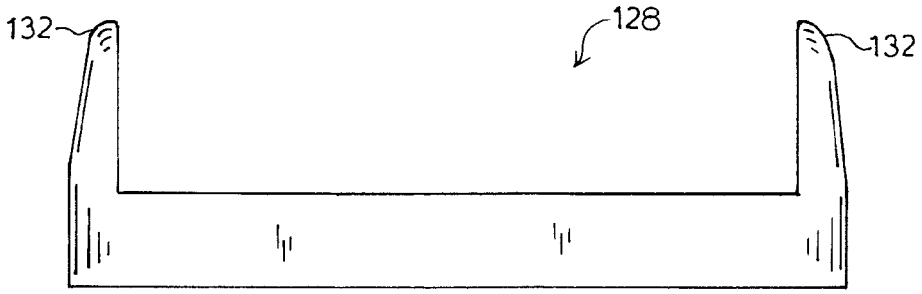
FIG. 7 is an elevation view of an embodiment of a support member for use in the fluid dispensing apparatus as shown in FIG. 1.
Figure 8A:
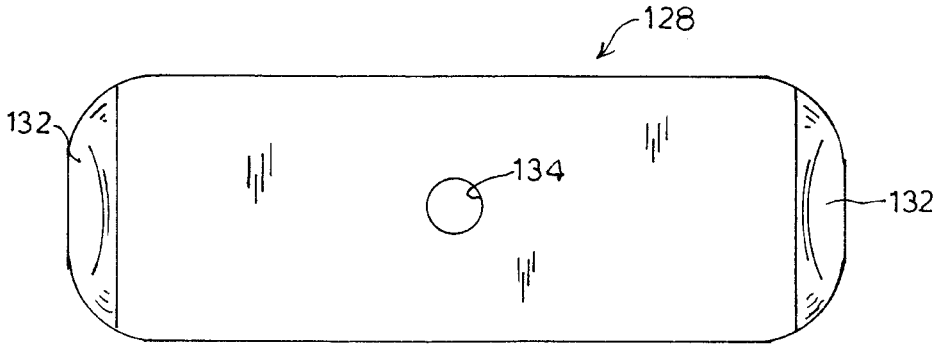
FIG. 8A is a top plan view of the support member as shown in FIG. 7.
Figure 8B:
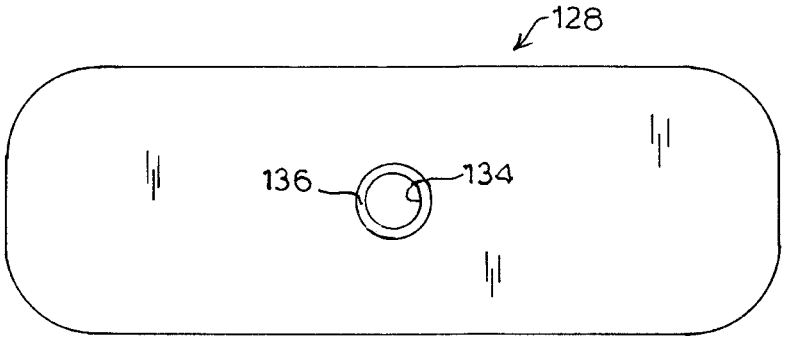
FIG. 8B is a bottom plan view of the support member as shown in FIG. 7.
Figure 9:
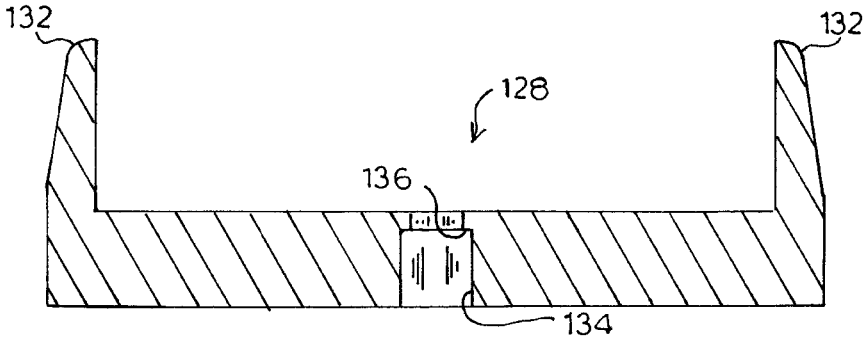
FIG. 9 is a longitudinal cross-section view of the support member as shown in FIG. 7.
Figure 10:
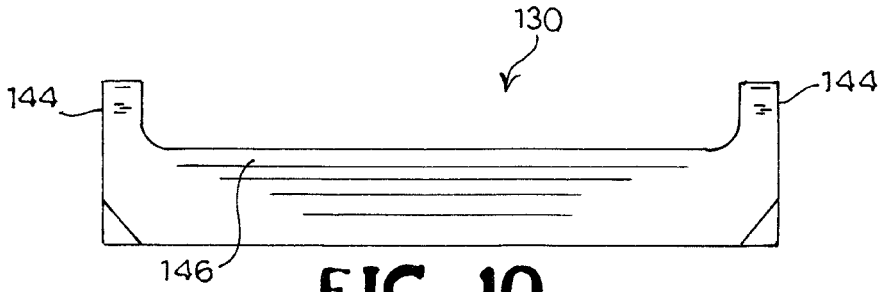
FIG. 10 is an elevation view of an embodiment of a tray member for use in the fluid dispensing apparatus as shown in FIG. 1.
Figure 11A:
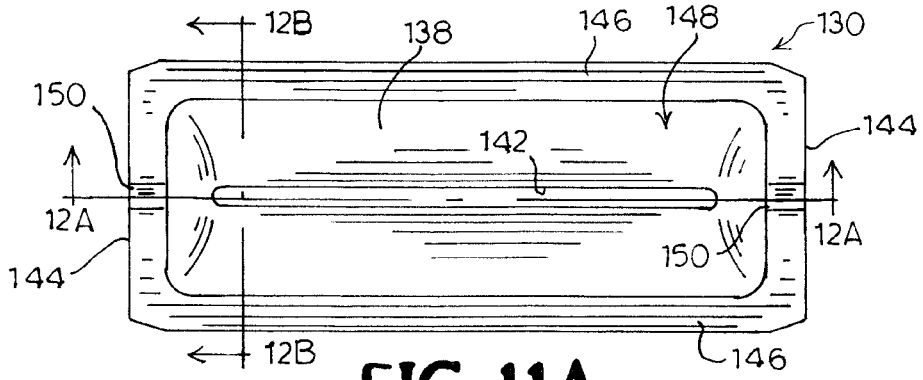
FIG. 11A is a top plan view of the tray member as shown in FIG. 10.
Figure 11B:
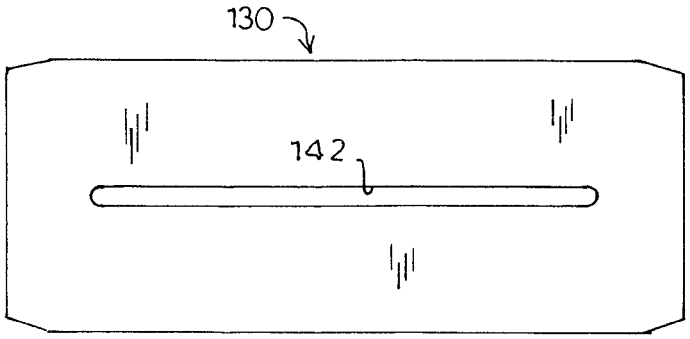
FIG. 11B is a bottom plan view of the tray member as shown in FIG. 10.
Figure 12A:
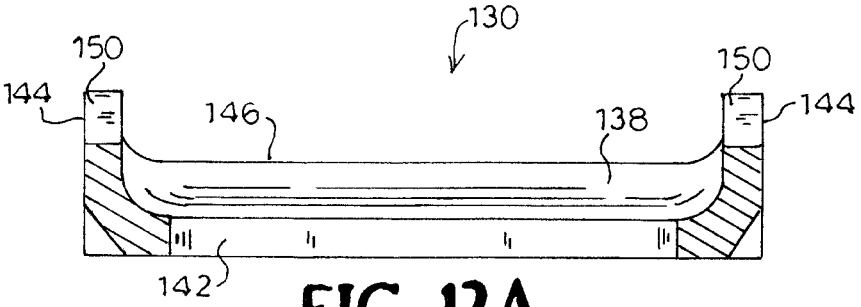
FIG. 12A is a longitudinal cross-section view of the tray member as shown in FIG. 10.

The inner surface of the base member 112 of the top plate 104 defines a central axial bore 126 (FIG. 6) for receiving the outer end of the pressurization chamber 74. An interference fit or a snap fit into the bore 126 may be provided for the pressurization chamber 74. Alternatively, the bore 126 may be internally threaded, for cylindrical configurations as shown, for removable threaded attachment of the pressurization chamber 74 within the bore 126. A more permanent attachment alternative includes gluing or welding the pressurization chamber 74 in the bore 126. The base member 112 of the top plate 104 also has a central port 127 opening into the bore 126. The port 127 is sized to pass the outer portion 90 of the piston member 76.

The upload tray 106 comprises an inner support member 128 and an outer tray member 130 (FIG. 2). Although the inner support member 128 and the outer tray member 130 of the upload tray 106 are depicted here as separate pieces, they could be combined in a single part depending on the manufacturing process employed. The upload tray 106 is configured as a floating bed and is actuated in cooperation with the pump assembly 54 to deliver fluid from the pressurization chamber 74 through the interior of the outer portion 90 of the piston member 76 to the outer tray member 130.

Figure 13:
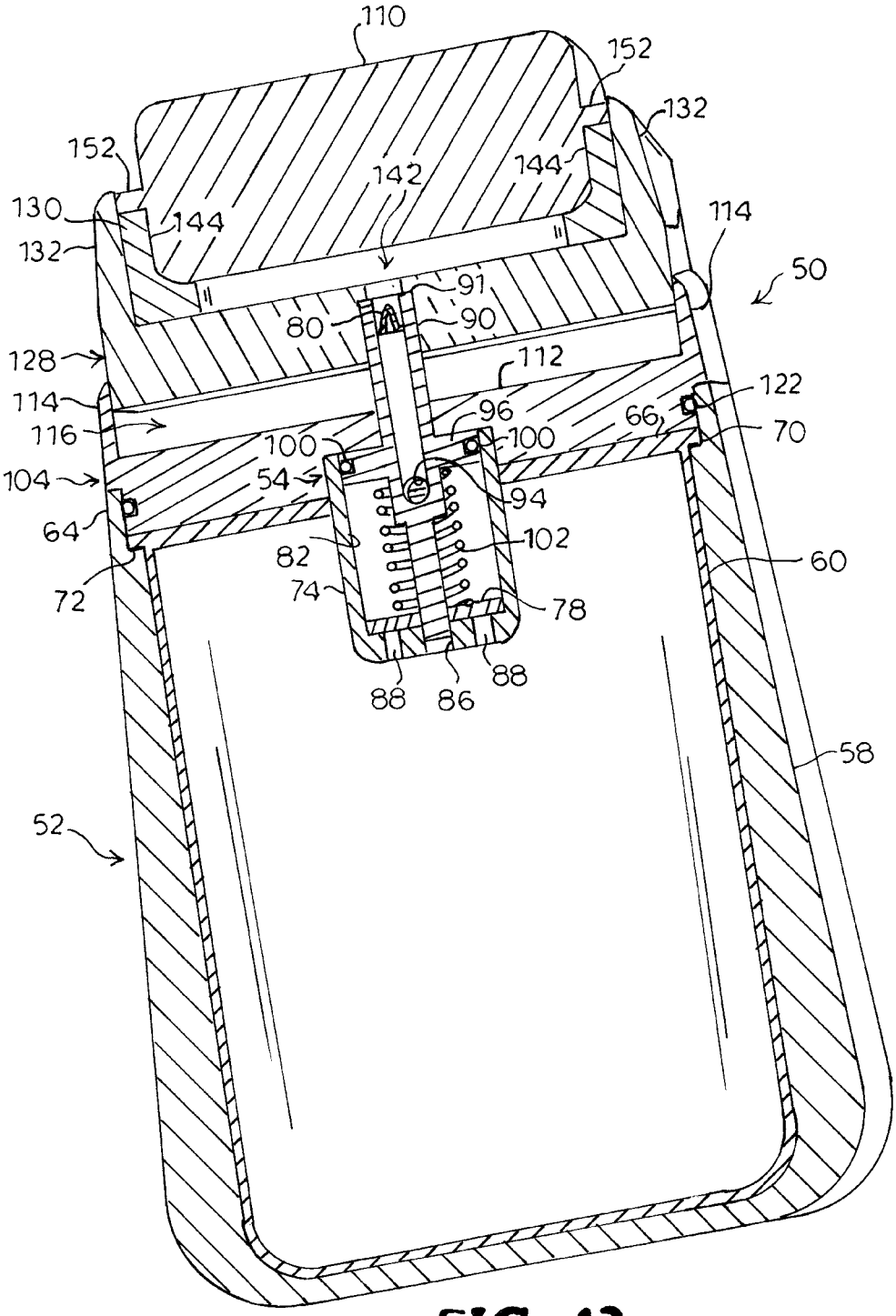
FIG. 13 is a longitudinal cross-section of the fluid dispensing apparatus as shown in FIG. 1 in a first position.
Figure 14:
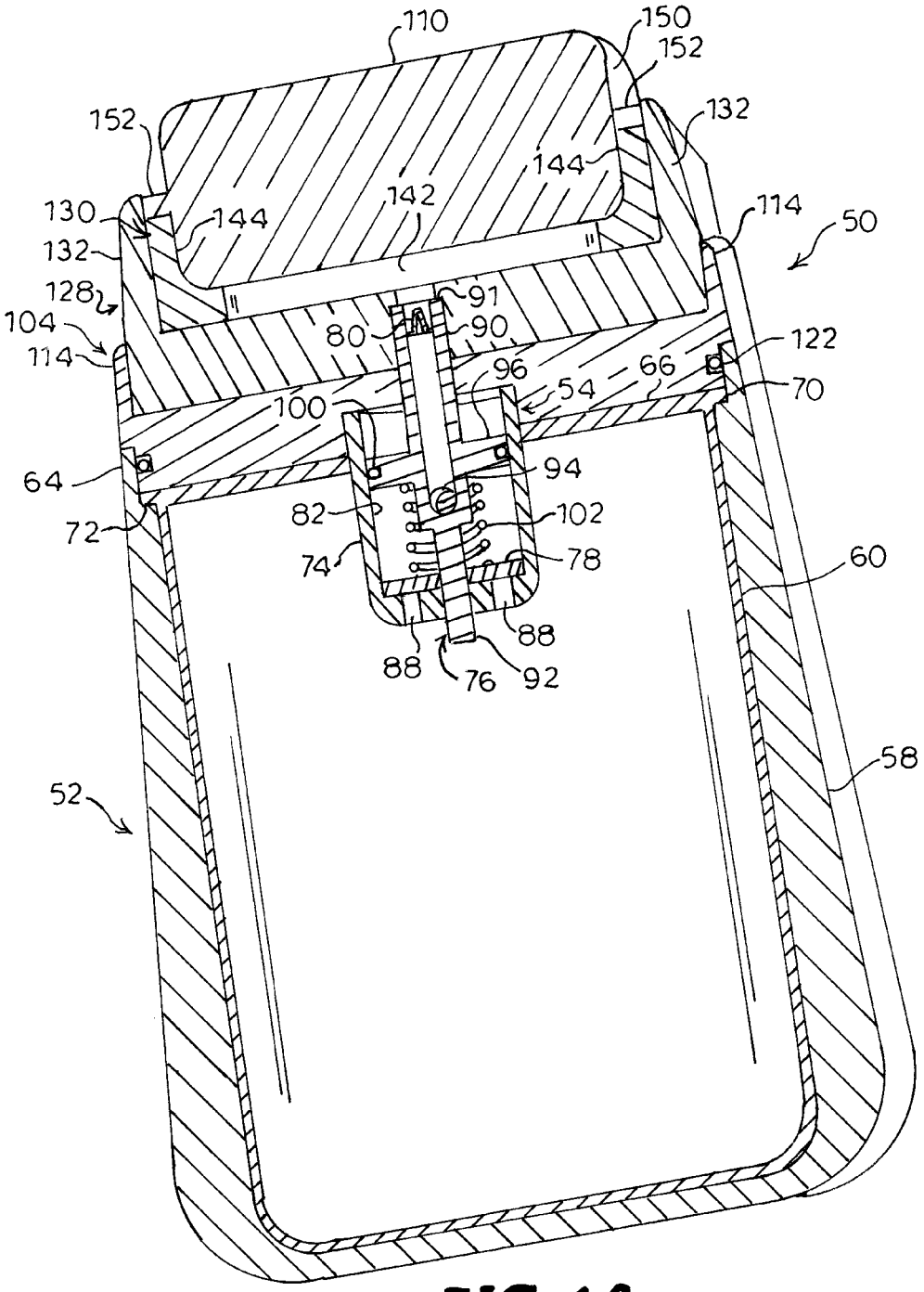
FIG. 14 is a longitudinal cross-section of the fluid dispensing apparatus as shown in FIG. 13 in a second position.

Referring to FIGS. 7-9B, the inner support member 128 is a generally planar component having outwardly extending legs 132 at each end. The support member 128 defines a central opening 134 wherein the diameter of the outer end of the opening is reduced forming an interior shoulder 136. The support member 128 is configured to slidingly fit within the cavity 116 of the top plate 104. As seen in FIGS. 2, 13 and 14, the central opening 134 of the support member 128 is adapted to receive the outer end 91 of the piston member 76. The outer end 91 of the piston member 76 may be press fit into the opening 134 and seat against the shoulder 136. In this arrangement, the upload tray 106 is in fluid communication with fluid in the liner 60 via the piston member 76. Referring to FIGS. 10-12B, the outer tray member 130 is a generally planar component having a concave outer surface 138. The outer tray member 130 has outwardly projecting end walls 144 and spaced sidewalls 146 which interconnect the end walls. The end walls 144 and sidewalls 146 of the outer tray member 130 together with the concave outer surface 138 define an elongated recess 148. The outer surface 138 of the tray member 130 defines a central channel 142 opening into the recess 148 and extending transversely along a midline from the outlet port 140 substantially over the entire length of the outer tray member 130. The outer tray member 130 is configured to fit snugly against the surface of the support member 128 between the legs 132.

In another embodiment (not shown), a plurality of fluid dispensing ports may be provided in the upload tray 106 in a predetermined spacing, locations and sizes to deliver fluid to the roller 110. The dispensing ports may be in a generally linear array between the end walls 144 with an internal manifold passage supplying each of the ports with fluid at a generally equal pressure. The size of the ports is selected to render the fluid dispensing apparatus 50 suitable for dispensing viscous fluids, such as sunscreen and bodily lotions.

The components of the applicator assembly 56 may be injection molded from a semi-rigid polymeric material, such as high impact polystyrene. It is understood that suitable components may be molded from other semi-rigid polymers or a resilient polymeric material. The applicator assembly may be molded from a thermoplastic elastomer, such as TPE (thermoplastic elastomers). However, other resilient materials may be used including, but not limited to silicone, natural rubber, latex rubber, butyl rubber, nitrile rubber, or metal. It is understood that the scope of the fluid dispensing apparatus is not intended to be limited by the materials listed here, but may be carried out using any material which allows the construction and operation of the fluid dispensing apparatus described herein.

As shown in FIGS. 1 and 2, the roller 110 comprises an elongated cylindrical roller. In this embodiment, the roller 110 provides rapid uniform delivery of fluid over large areas of skin. The roller 110 is supported by the outer tray member 130. The end walls 144 have opposed journal apertures 150. The roller 110 includes axle projections 152 on the ends of the roller 110 that rotatably engage the corresponding apertures 150 allowing for rotatable attachment of the roller 110 in the recess 148 of the outer tray member 130. The end walls 144 or the roller 110 may be sufficiently resilient to allow deformation so that the axle projections 152 engage or disengage with the upload tray member 130.

The upload tray assembly 106 and the roller 110 are movable together relative to the housing 58 so as to be capable of being depressed inwardly against the bias of the spring 102 of the pump assembly 54 as a consequence of the user pressing the roller 110 inward, for example, against the skin. This actuates the pump assembly 54 for supplying fluid with the roller 110 in rolling contact with the skin for dispensing fluid onto the skin. With this arrangement, the user is only required to bring the roller 110 in contact with the skin and apply pressure to actuate the pump assembly 54 for transferring the fluid to the upload tray 106 each time the applicator assembly 56 is depressed. The applicator assembly 56 performs the dual function of both actuating the pump assembly 54 while also dispersing the fluid in a controlled manner necessary to achieve the uniform coverage desirable in some applications.

In one embodiment, the roller 110 may have a textured surface. The textured surface may be provided by grooves or projections of different sizes, shapes and geometries. The grooves or projections may also have different patterns or may be oriented at different angles with respect to the longitudinal axis of the roller, such as in a zigzag, chevron, herringbone, hex, dot, or checkerboard patterns. In particular, the grooves may have a depth of about 0.005" to 0.05" for hard surface rollers and 0.005" to 0.25" for pliable surfaces. The projections may represent raised areas spaced apart or interconnected to define one or more open channels. The projections can be in the form of nubs or fin segments that are arranged in rows oriented generally parallel to the blades or spaced fin segments that are arranged both parallel to and perpendicular to the blades. Whether using grooves or projections, and without being bound by theory, it is believed the textured roller 110 will pick up a volume of fluid from the tray member 130. The textured surface also provides traction on the skin to allow the roller 110 to roll and not slide on the skin. The latter causes smearing of fluid, whereas rolling application spreads fluid evenly.

A non-porous, rigid roller 110 surface is preferred. In another embodiment, the roller 110 may be made of a synthetic or natural material suitable for absorbing fluid and dispensing the fluid upon surfaces against which the roller is rolled. A non-porous roller with a firm surface is preferred as it minimizes wear, clogging, smearing or slipping. The roller may also be formed from an elastic material. Further, it is understood that the roller 110 as a fluid application member can be any rotatable element, such as a generally toroidal element. For example, a rotary ball applicator may be used to dispense fluid. The rotary ball is normally biased against a spring member via an elongated biasing element to prevent dispensing of the fluid.

In an alternate embodiment, a flexible sleeve can be mounted on a solid roller core (not shown). Such a configuration provides a pliable surface of the flexible sleeve to make contact with skin while retaining the rigid core foundation to enable the actuation of the pump assembly 54. The flexible sleeve can have any particular surface texture as demanded by the particular liquid application demand. A cupped surface is preferred since it can effectively collect fluid from the upload tray 106 while effectively delivering the fluid as the flexible surface comes into contact with the skin, deforms at its surface and releases the fluid as desired on the skin contact point. It is anticipated that instead of an attachable flexible sleeve, a similar result can be achieved by affixing a flexible material onto the exterior of the rigid core. This over molded surface can incorporate a range of surface textures including a cupped, ridged, channeled surface, or combination of these patterns.

In yet another embodiment, a fluid application member may comprise a rigid blade member (not shown). The blade member has at least one aperture that is in fluid communication with the pressurization chamber 74 for dispensing fluid on the skin. The body of the blade member tapers to an edge laterally along its length, providing a beveled surface amenable to spreading fluid as the blade is rapidly passed along the skin surface. In this embodiment, the blade member constitutes the actuator that is supported on the upload tray 106 to be movable relative to the reservoir assembly 52 for actuating the pump assembly 54 each time the blade member is pressed against and released from the skin for delivering fluid.

Figure 17:
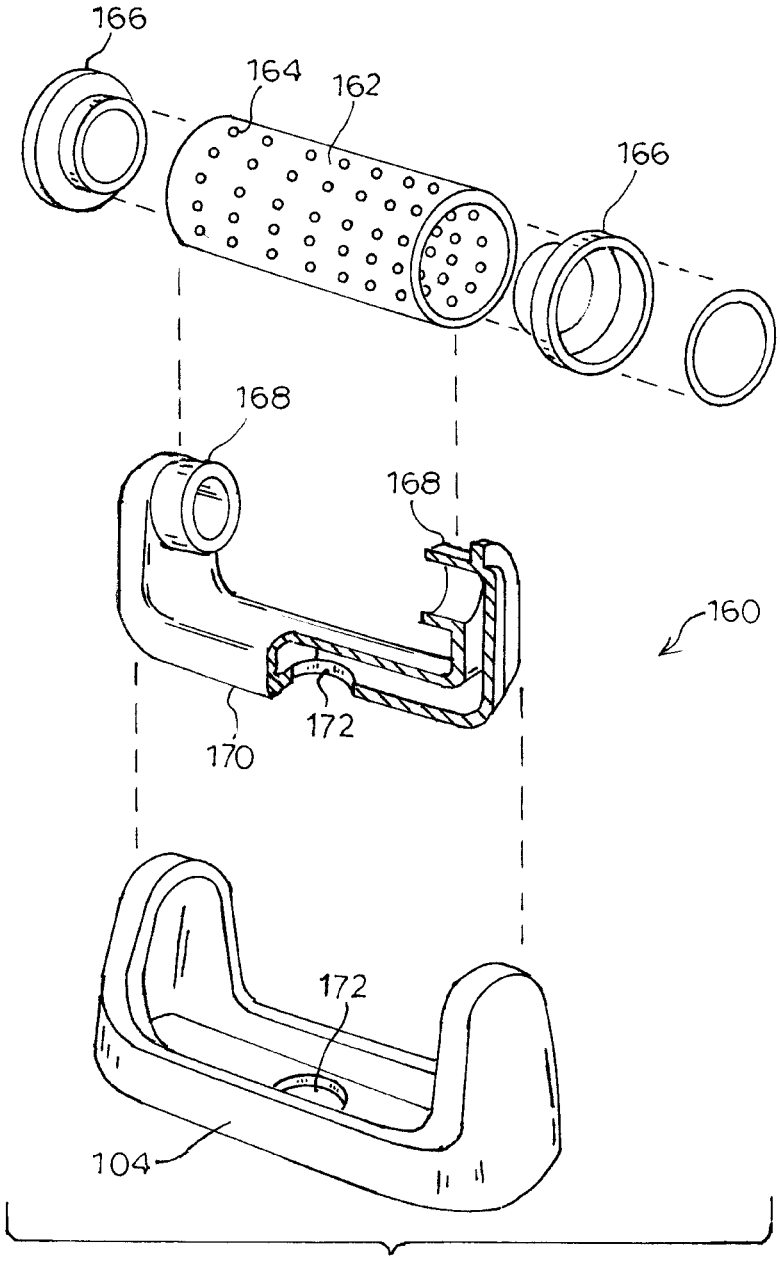
FIG. 17 is an exploded perspective view of an embodiment of a roller assembly for use in the fluid dispensing apparatus as shown in FIG. 1.

Another embodiment of the applicator assembly 56 is shown in FIG. 17 and generally designated at 160. In this embodiment, a roller 162 is sufficiently porous to allow fluid to be transferred under pressure from a hollow interior of the roller 162 to an exterior surface for application onto skin. Such porosity is provided by holes 164 that act as tubes for transferring fluid from the interior to the exterior, or by using mesh, foam or other materials that permit the transfer of pressurized fluid. The roller 162 rotates on axles 166 that are hollow and connect to the vertical support stanchions 168 rising from the support tray 170. The support stanchions 168 are hollow and open to the axle interiors enabling fluid to flow to the interior of the roller 162. The interior of the stanchions 168 open to each other at a midpoint juncture 172 that is in fluid communication with the top plate 104. Accordingly, when the roller 162 is pressed onto the skin, reciprocation of the support tray 170 actuates the pump assembly 54, transferring fluid from the liner 60 through the stanchions 168 and into the roller 162 interior where the fluid passes through the porous roller material and is dispensed.

A cap 154 may be provided for covering the applicator assembly 56, including the top plate 104, when the fluid dispensing apparatus 50 is not in use. Features may be provided to enable the cap 154 to be attached, such as clips, flange edge, grooves, anchor points for latches, tabs, clips, magnets or other attachment means. The benefit of the attachment means is to minimize the risk of losing the cap 154 when not covering the applicator assembly 56. The cap 154 may also have indentations, bumps, ridges, or other surface shapes or textures to provide grip points for fingers in the process of cap removal and replacement and also aid in gripping when attached temporarily to the housing 58 during use. Such features may also include a flat surface that supports the housing 58 during the process of refilling.

Referring to FIG. 2, to assemble the fluid dispensing apparatus 50, the liner 60 is positioned within the housing 58. The applicator assembly 56 is then mounted onto the housing 58 over the liner 60. In this arrangement, the pressurization chamber 74 fits into the opening 68 in the top wall 66 of the liner 60. The flange 70 on the liner 60 is sealed between the shoulder 72 in the outer end 64 of the housing 58 and the bottom surface of the top plate 104. Disassembly is the reverse of assembly, beginning with pulling the applicator assembly 56 from connection to the housing 58. The applicator assembly 56 may be further disassembled by removing the roller 110 from between the end walls 144 of the tray member 130. The applicator assembly 56 may be cleaned and the roller 110 replaced, if preferred.

In use, and referring to FIGS. 2 and 13-16, the user grasps the housing 58 and places the roller 110 in contact with an area of skin to be covered with fluid. The user then presses the roller 110 against the skin. The pressure applied on the roller 110 forces the connected upload tray 106 inwardly into the cavity 116 defined by the walls 114 of the top plate 104. As the upload tray 106 moves inwardly, the piston member 76 connected to the upload tray 106 is also moved inwardly relative to the pressurization chamber 74 and against the force of the spring 102. As the piston head 96 advances toward the inner wall of the pressurization chamber 74, the spring 102 is compressed between the piston head 96 and the stop valve 78 on the bottom of the pressurization chamber 74. Concurrently, the volume of the chamber 82 is reduced, generating positive pressure within the chamber. Due to the positive pressure in the chamber 82, the stop valve 78 is forced against the bottom of the pressurization chamber 74 sealing the intake ports 88. The fluid in the variable volume chamber 82 is forced through the port 94 and the hollow outer portion 90 of the piston member 76. The pressurized fluid moving through the piston member 76 opens the duckbill valve 80 at the outer end 91 of the piston member 76. The fluid exiting the duckbill valve 80 passes through the opening 134 in the support member 138 and the outlet port 140 onto the outer surface 138 of the tray member 130. The fluid is distributed laterally from the outlet port 140 along the channel 142 in the tray member 130 between the outer surface 138 of the tray member 130 and the roller 110. When the user moves the roller 110 along the skin, the roller rotates. The rotating roller 110 picks up the fluid and draws the fluid past the edge of the side walls 146 of the tray member where the fluid is screened to a uniform layer that is then delivered to the skin as the roller 110 continues to rotate further while making contact with the skin.

Figure 15:
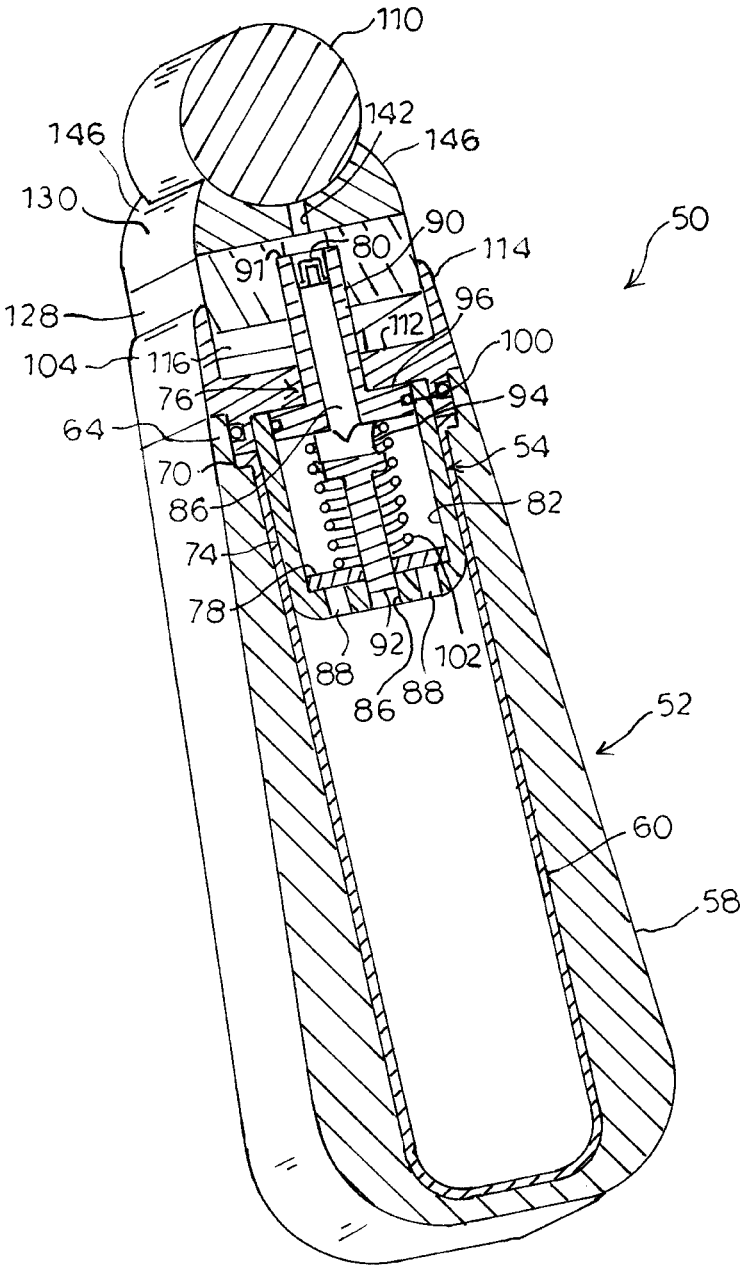
Figure 16:
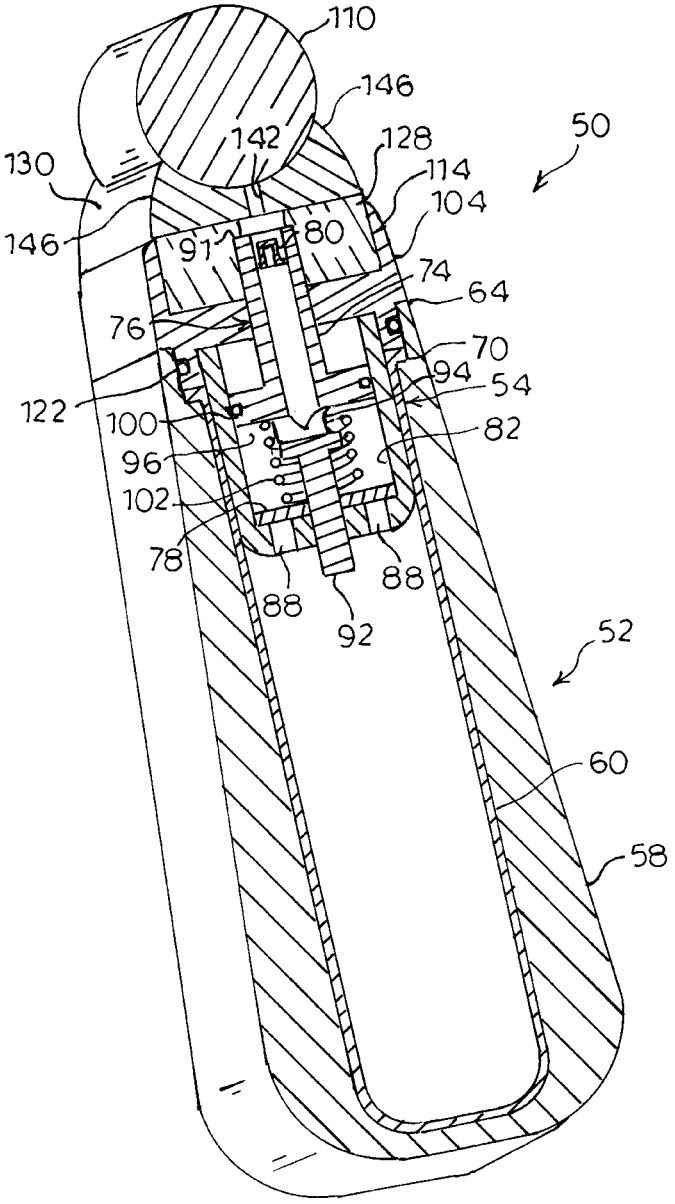
FIG. 16 is a transverse cross-section of the fluid dispensing apparatus as shown in FIG. 14 in a second position.

The upload tray 106 retains unused fluid in an area above the tray member 130 and beneath the roller 110 to reduce leakage that may otherwise result from excess fluid accumulating on the exposed surface of the applicator assembly 56. Such unused fluid is held in the tray member 130 awaiting transfer to the roller 110 during rotation. As shown in FIGS. 15 and 16, the outer surfaces of the side walls 146 taper to the edges of the side walls 146 of the tray member 130 adjacent to the roller 110. In use, the side walls 146 screen excess fluid from the rotating roller 110 when passing through a clearance between the side walls and the roller prior to dispensing fluid over the skin. The close fit of the roller 110 in the recess 148 of the tray member 130 helps provide a more uniform fluid coating on the roller 110 and reduces fluid buildup on the edges of the tray member 130. With this arrangement, fluid application to the skin is more efficient and reduces repetitive passage on the skin to place uniform layer of fluid.

When substantial pressure is released from the roller 110, though the roller 110 is not necessarily out of contact with the skin, the spring 102 returns the piston member 76 to the home position (FIGS. 13 and 15) with the piston head 96 against the inner surface of top plate 104 along with the upload tray 106 and roller 110 to their most outward position. This movement increases the volume of the chamber 82 and generates negative pressure within the pressurization chamber 74. Due to the negative pressure, the duckbill valve 80 closes preventing fluid and air from flowing back through the piston member 76. The negative pressure further causes the stop valve 78 to deform along its circumference for drawing fluid from the liner 60 into the chamber 82 through the intake ports 88 in the bottom wall of the pressurization chamber 74. The flexible liner 60 is deformable and contracts as fluid is drawn into the pressurization chamber 74. Air does not enter the liner 60, which enables inverted operation and eliminates the need to shake fluid into position to be taken up into the pressurization chamber 74 via the intake ports 88. One or more vent holes may be provided in the housing 58 to enable the liner 60 to more easily contract.

Thus, in response to roller 110 pressure against the skin, the pump assembly 54 is actuated for changing a volume of the chamber drawing fluid from the reservoir assembly 52 and dispensing the fluid onto the skin. The pressurization chamber 74 functions to draw fluid in increments from the liner 60 in quantities that vary based on user input. At the same time, the fluid is delivered to the skin as a consequence of the reciprocation of the applicator assembly 56 relative to the reservoir assembly 52 and rotation of the roller 110 in contact with the skin. A particular advantage of the pump assembly 54 is that piston operation in a rigid chamber can generate significant pressure based upon the input pressure received from the applicator assembly 56 being pressed onto a surface. This performance attribute is favorable in certain applications in which greater pumping pressures are demanded, such as for rapid delivery, or to deliver more viscous fluids. Another advantage of the pump assembly 54 is the piston reacts immediately to changes in input pressure from the applicator assembly 56 as contact is made with the surface. This attribute allows the user to closely regulate the amount of fluid flow at any time by changing the amount of input pressure. Still another advantage to the pump assembly 54 is that the pump assembly, inclusive of valves, ports, piston components and the spring, is contained within a single compact element. This minimizes the amount of space for the pumping operation, thereby increasing the amount of space available for fluid storage and for other components of the fluid dispensing apparatus 50.

It is preferred the applicator assembly 56 may make light contact with the skin without activating the flow of fluid. This operating feature is desirable to provide the user with the ability to use the applicator surface to spread fluid that has already been discharged onto the skin. Accordingly, the spring 102 is sufficiently resilient to resist light inward force of the applicator assembly 56 without actuating the flow of fluid.

Once the reservoir assembly 52 is empty, the liner 60 may be refilled. As described herein, the applicator assembly 56 and associated pump assembly 54 are integrated and detachable from the housing 58, which renders the reservoir assembly 52 easy to refill, clean, or replace. The liner 60 can remain in the housing 58 or be removed for refilling or replacement. Alternatively, the reservoir assembly 52 may incorporate a sealable refilling opening on a side of the housing 58 adjacent to or opposite the applicator assembly 56. The opening would have a sealing cap that attaches by means of screwing, snapping or other means of sealable capture. The cap may incorporate a tether to prevent it from being separated from the unit or a living hinge to allow pivotal attachment. The liner may also be replaced as a disposable element of the apparatus.

The fluid dispensing apparatus 50 may be used to apply, for example, sun screen or other body lotions. Other suitable fluids may include skin care compositions suitable for topical application, including, for example, shaving gels, lubricants, shaving foams, shaving lotions, shave oils, skin treatment compositions and creams, astringents, exfoliant scrubs, sun screens, cleansers, skin conditioning aids, ointments, imaging agents applied to the skin surface, depilatories, balms, lotions, moisturizers, fragrances, anesthetic lotions, and combinations thereof. Other fluids unrelated to personal care to be dispensed may include paints, adhesives, solvents, and other materials of a viscosity similar to that of commonly-used sun screens presently available. Further, other fluids with viscosities dissimilar to commonly-used sun screens may be delivered with the apparatus. This is possible by making readily apparent modifications in valves, ports, spring sizes, and other dimensions and materials of the apparatus as described.

Figure 18:
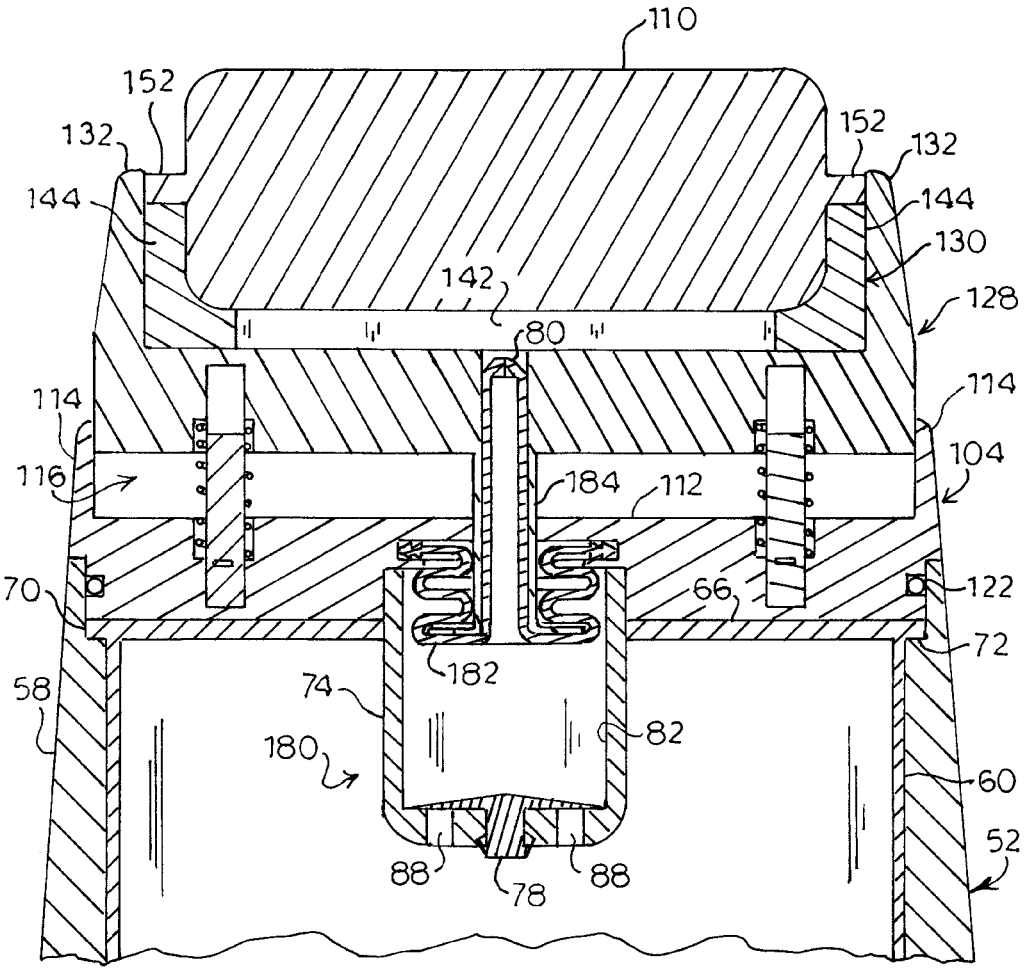
FIG. 18 is a longitudinal cross-section of another embodiment of a fluid transfer assembly for in a fluid dispensing apparatus as shown in FIG. 1 in a first position.
Figure 19:
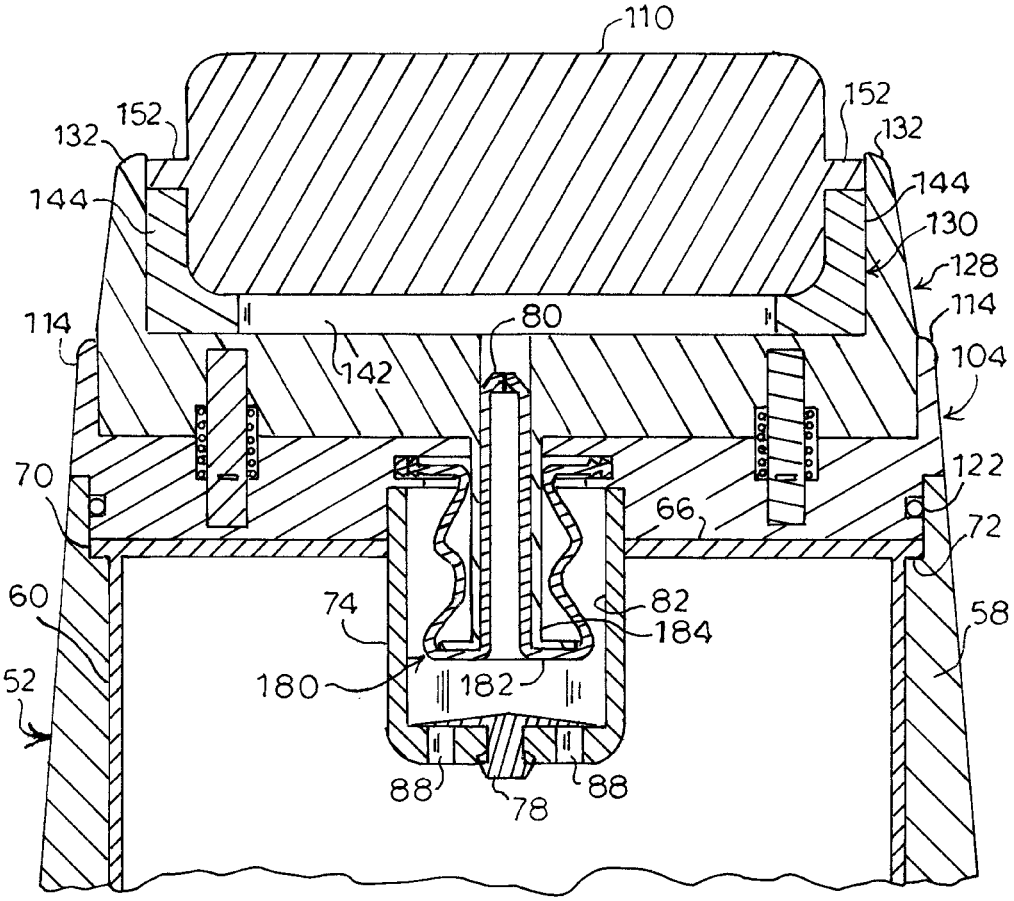
FIG. 19 is a longitudinal cross-section of another embodiment of a fluid transfer assembly for in a fluid dispensing apparatus as shown in FIG. 1 in a second position.

Referring to FIGS. 18 and 19, another embodiment of a pump assembly is shown and generally designated at 180. The pump assembly 180 comprises a bellows pump 182. A duckbill valve 80 is integral with the bellows pump 182. An outer wall of the bellows pump 182 is fixed relative to the top plate 104. A pump flange 184 extends inwardly into the bellows pump 182 from the upload tray 106. When the bellows pump 182 is extended into the pressurization chamber 74, the bellows pump 182 displaces a volume of fluid through the duckbill valve 80. The displacement of the fluid is thus accomplished without the resistance of the other embodiment of the pump assembly 54, thus reducing the force necessary to displace fluid by means of a linear motion. In another embodiment, the fluid dispensing apparatus 50 may be configured such that it does not include a reservoir assembly 52 or a liner 60. In this embodiment, the fluid dispensing apparatus 50 is adapted to be easily attached to existing packages of fluid, such as bottles, tubes or containers that are already produced and sold as prefilled volumes of fluid. A one-way valve, such as a duckbill valve, would be incorporated into the receptacle that is to receive the prefilled package that would allow the internal pressure of the package to be equalized when fluid is withdrawn via the fluid delivery system. In an embodiment without a liner, the body would be sealed so that the fluid is contained directly within the outer device walls. A sealably attached cap would be incorporated for refilling the device. A duckbill valve or other one way valve would also be incorporated into the cap or the body of the device, thereby allowing air to be drawn into the unit when fluid is drawn out by the fluid dispensing apparatus 50.

Figure 20:
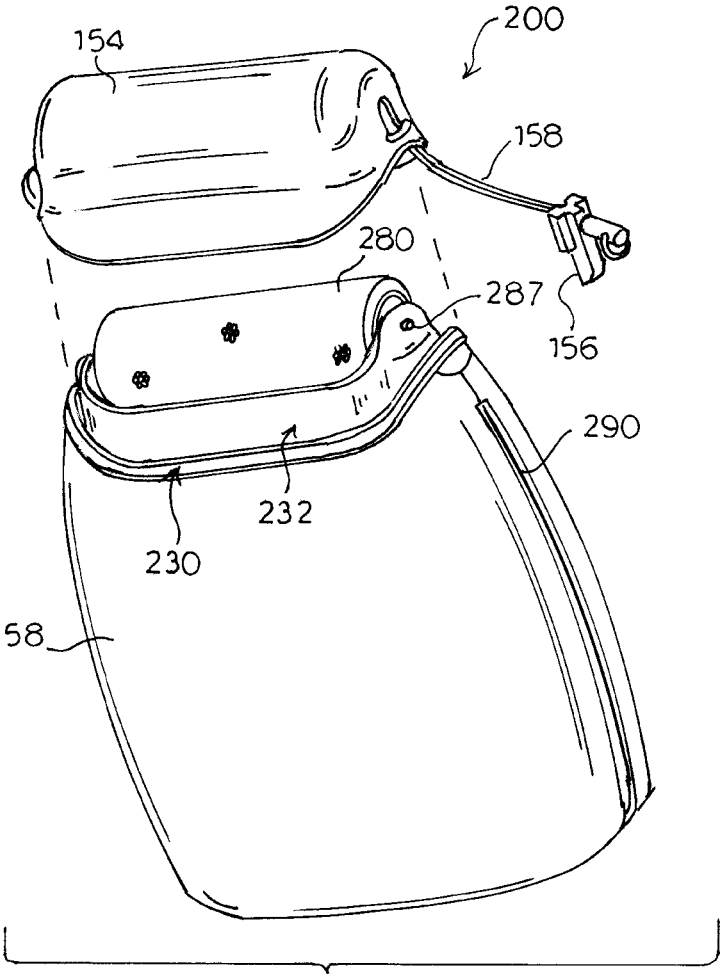
FIG. 20 is a perspective view of another embodiment of an apparatus for dispensing fluid.
Figure 21:
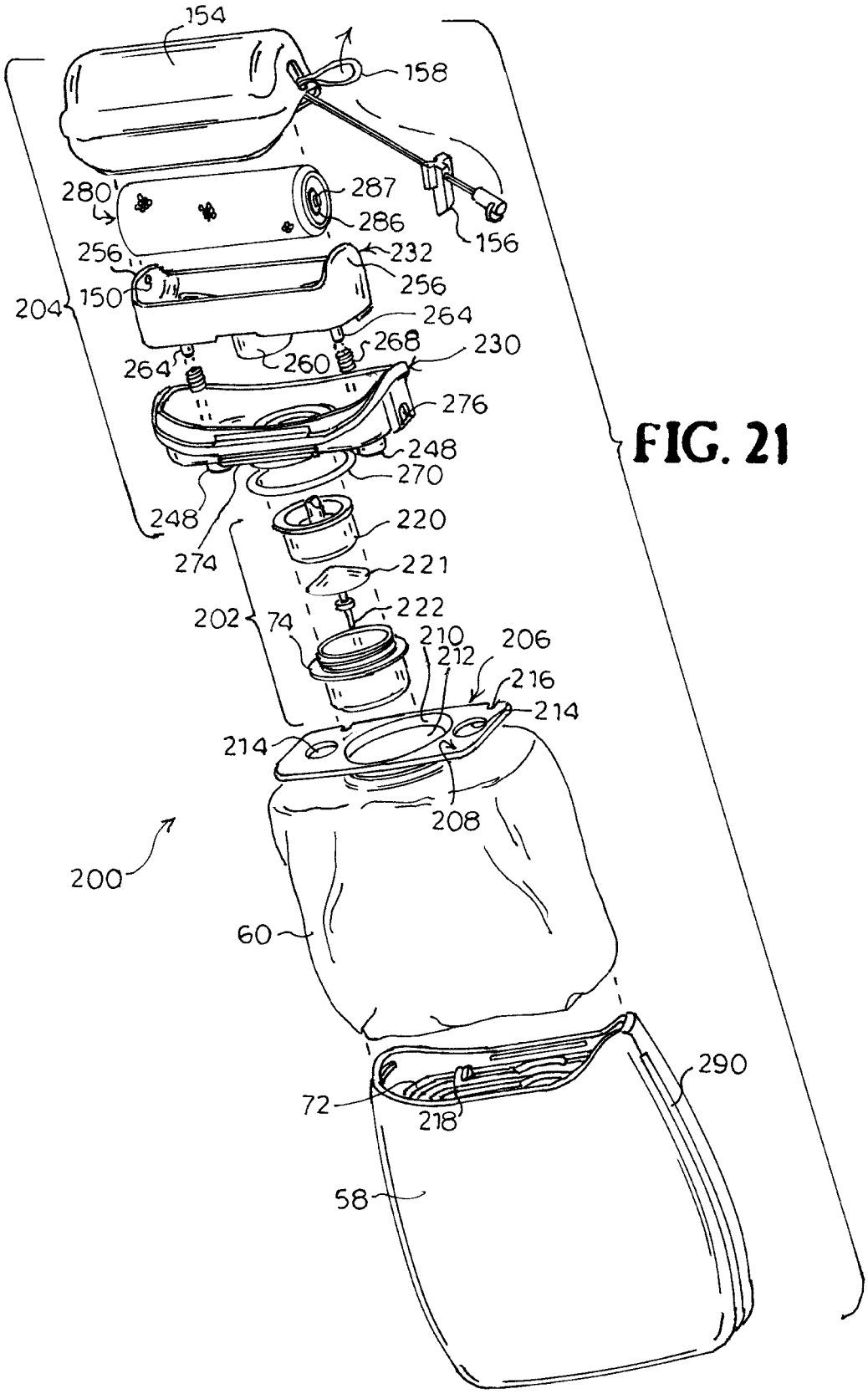

Another embodiment of an apparatus for dispensing a fluid is shown in FIGS. 20 and 21 and generally designated at 200. In the drawings, like reference numerals from previously described embodiments designate corresponding or similar elements throughout the several views. The fluid dispensing apparatus 200 comprises a pump assembly 202 in fluid communication with the reservoir assembly 52, and an applicator assembly 204 for applying the fluid on a surface, such as skin of a human body, in fluid communication with the pump assembly 202.

Figure 22A:
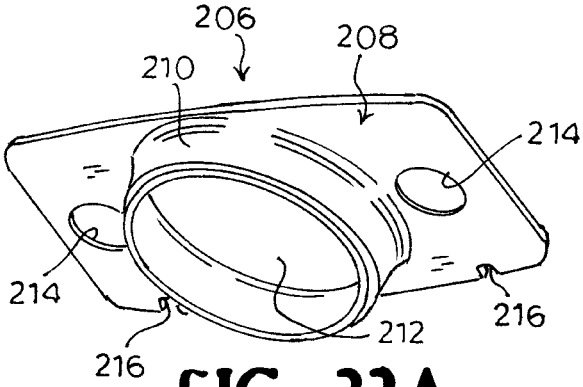
FIG. 22A is a bottom perspective view of an embodiment of a liner plate for use in the fluid dispensing apparatus as shown in FIG. 20.
Figure 22B:
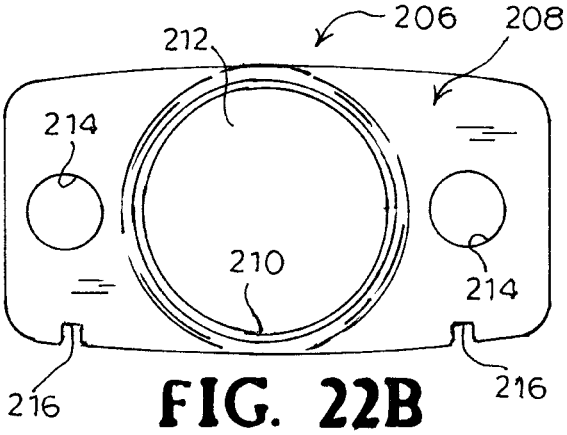
FIG. 22B is a top plan view of the liner plate as shown in FIG. 22A.
Figure 22C:
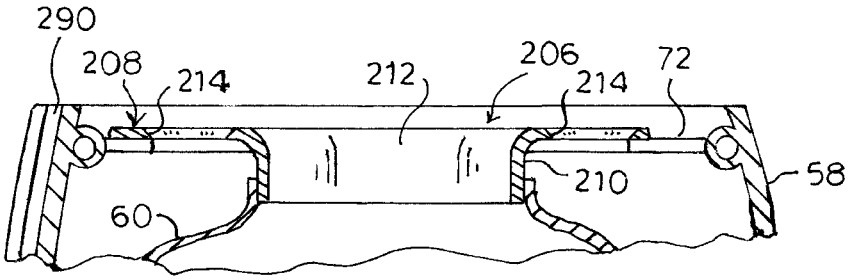
FIG. 22C is a longitudinal cross-section view of the liner plate as shown in FIG. 22A.

In this embodiment of the fluid dispensing apparatus 200, a liner plate 206 is associated with the liner 60 of the reservoir assembly 52. Referring to FIGS. 22A-22C, the liner plate 206 comprises a generally planar base member 208 and an integral central cylindrical flange 210 extending inwardly from the base member 208. The base member 208 and the flange 210 together define a central axial opening 212 through the liner plate 206. A pair of circular holes 214 is spaced along the central longitudinal axis of the base member 208, each hole 214 radially spaced equidistant from the side of the central opening 212. As shown in FIG. 22C, the circular opening 68 defined by the top wall 66 of the liner 60 is configured to receive the flange 210 of the liner plate 206. In this arrangement, the liner 60 is in sealing engagement with the exterior of the flange 210. The liner 60 may be permanently attached to the flange 210 using adhesive or other suitable sealing means. The exterior surface of the flange 210 may have surface textures or structure that enable fixation of the liner 60, and may vary depending upon the manner of attachment of the liner, whether by adhesive, heat, mechanical attachment, and the like.

Figure 23:
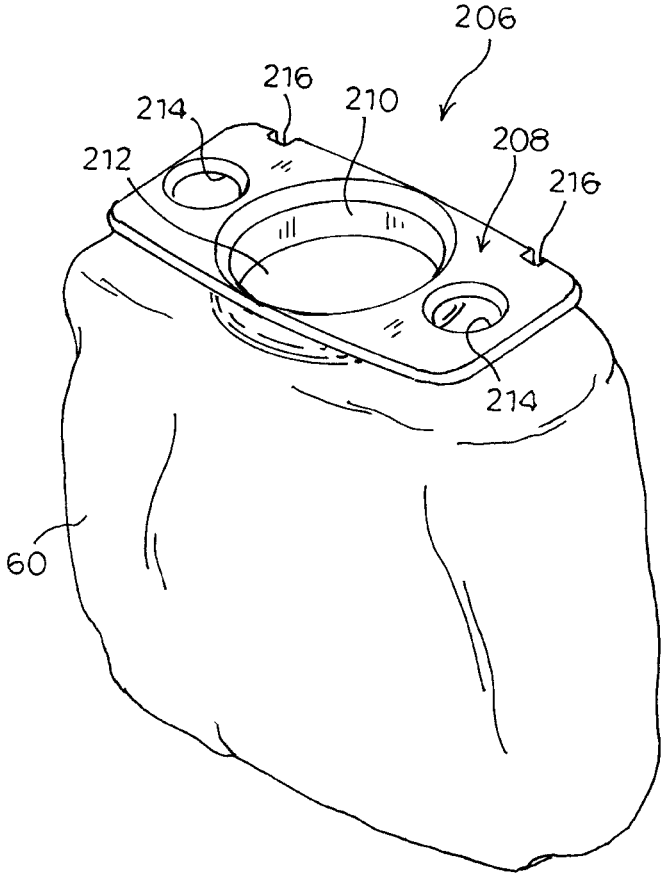
FIG. 23 is a perspective view of the liner plate as shown in FIG. 22A and the liner for use in the fluid dispensing apparatus as shown in FIG. 20.

The liner plate 206 is sized and shaped to fit against the shoulder 72 along the inside edge of the outer end 64 of the housing 58. A pair of notches 216 is longitudinally spaced along one edge of the base member 208 of the liner plate 206 and configured to receive corresponding tabs 218 provided on the shoulder 72 of the housing 58. It is understood that in this arrangement the liner 60 depends from the liner plate 206 (FIG. 23) and into the cavity 62 of the housing 58 such that the liner 60 is disposed within the housing 58. As in the previous embodiment described herein, the liner 60 and the associated liner plate 206 are removable for cleaning, refilling or replacement with, for example, prefilled liners. The user can also fill the liner 60 while the liner and the liner plate 206 are in the housing 58. An indicator (not shown) may be provided on the liner plate 206 to identify a maximum fill level to minimize spills during filling or when the pump assembly 204 is attached to the reservoir assembly 54. The alternative prefilled liner may comprise a peel-off seal over the central opening 212 in the liner plate 206. The seal may be removed or punctured during insertion, thereby allowing access to the fluid for use.

Figure 24A:
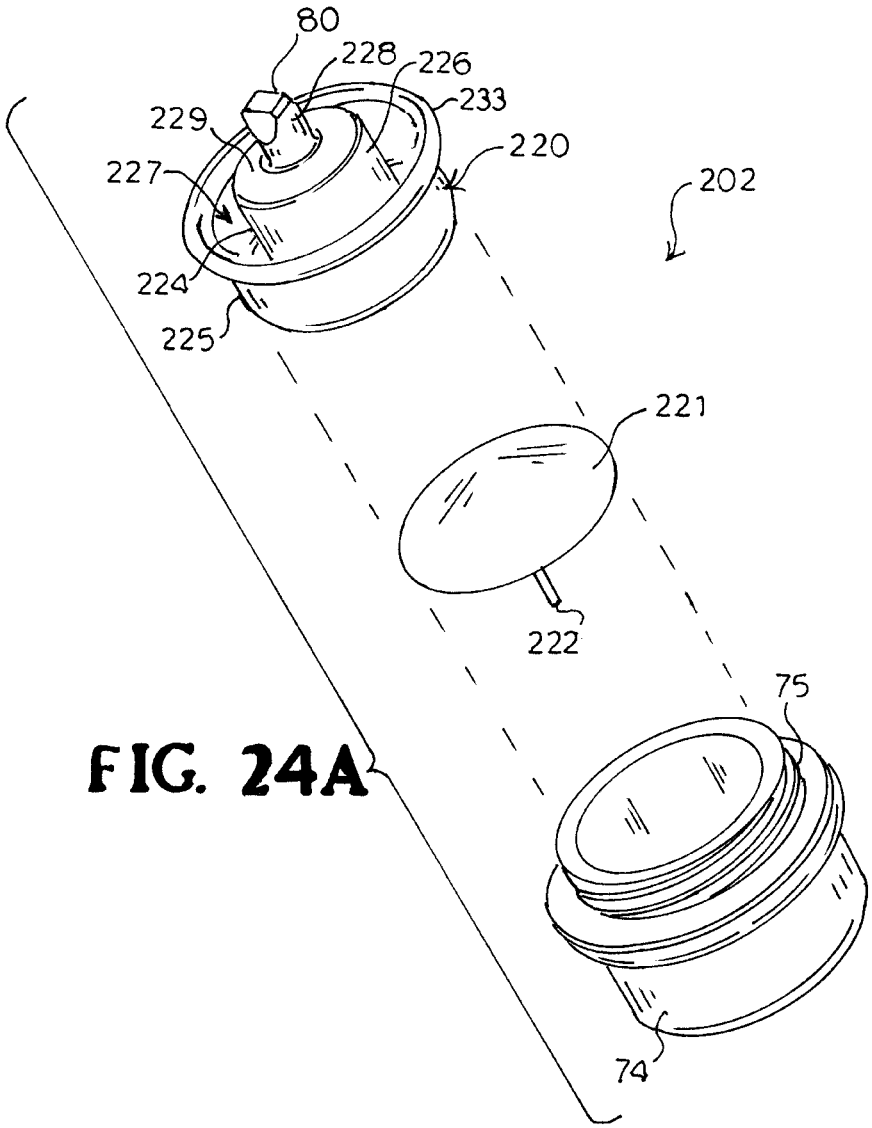
FIG. 24A is a top exploded perspective view of an embodiment of a pump assembly for use in the fluid dispensing apparatus as shown in FIG. 20.
Figure 24B:
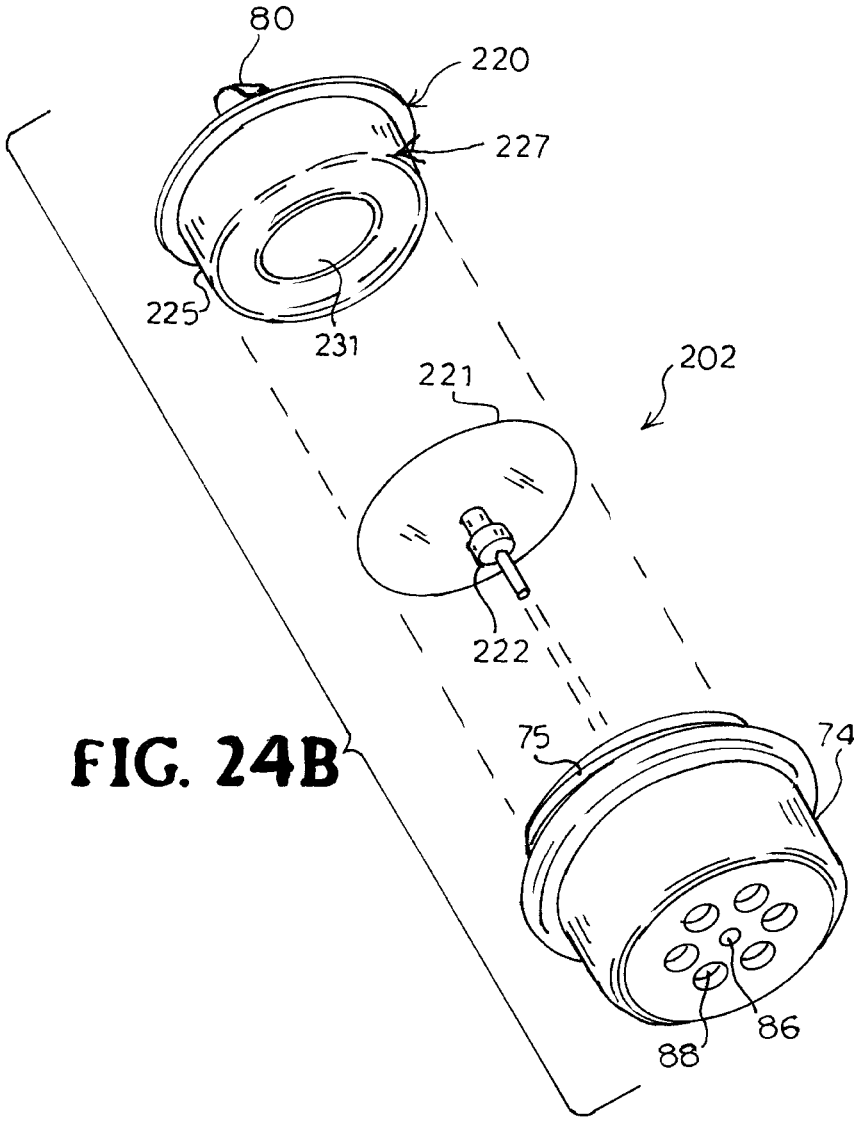
FIG. 24B is a bottom exploded perspective view the pump assembly as shown in FIG. 24A.

The pump assembly 202 provides a means for drawing fluid from the reservoir assembly 52 and delivering the fluid to the applicator assembly 204 for dispensing the fluid. As shown in FIGS. 24A and 24B, the pump assembly 202 comprises the pressurization chamber 74 for temporarily storing fluid received from the reservoir assembly 52, an inlet valve 221 for permitting fluid to be drawn into the pressurization chamber 74 from the reservoir assembly 52, and a bellows member 220 including an outlet valve 80 permitting the fluid to be delivered from the pressurization chamber 74 to the applicator assembly 204. As described herein below, the pump assembly 202 is actuated for drawing fluid from the reservoir assembly 52, pressurizing the fluid within the pressurization chamber 74, and delivering the fluid to the applicator assembly 204.

The inlet valve 221 is a circular umbrella valve disposed at the inner end 84 of the pressurization chamber 74. The umbrella valve 221 includes a central axial tab 222 extending inwardly from the body of the valve. The tab 222 is sized to pass through the central axial opening 86 in the inner end 84 of the pressurization chamber 74 for retaining the umbrella valve 221 in position. The diameter of the umbrella valve 221 is the same as the interior diameter of the pressurization chamber 74. The umbrella valve 221 seal against the bottom wall of the pressurization chamber 74 such that a fluid path from the liner 60 via the intake ports 88 is normally closed by the umbrella valve 221.

The bellows member 220 is disposed at the outer end of the pressurization chamber 74. The bellows member 220 is a flexible, elastic piece which, in a rest position, is generally cup-shaped. In this position, the bellows member 220 forms a resiliently deformable inner cylinder 226 nested within a concentric outer cylinder 227 having a larger outside diameter than the inner cylinder 226. The depth of the inner cylinder 226 and the outer cylinder 227 is substantially the same. In longitudinal cross-section (FIGS. 29 and 31), the bellows member 220 is generally "W-shaped", comprising a contiguous inner wall 224 and outer wall 225. A central tubular projection 228 extends outwardly from the inner cylinder 226 forming a cylindrical shoulder 229. The inner cylinder 226 and the tubular projection 228 of the bellows member 220 define a longitudinal passage 231 open at an inner end. The passage 231 extends the length of the bellows member 220 and serves as a conduit for fluid flow through the bellows member 220. As shown in FIGS. 24A and 24B, the peripheral edge of the outer wall 225 of the bellows member 220 has an annular lip 233. It is understood that the bellows member 220 may be other shapes including, for example, an ovular shape. A bellows member 220 having an ovular shape may allow for the fluid dispensing apparatus 200 to be slimmer if a more narrow embodiment is desirable.

The bellows member 220 is formed from a sufficiently flexible, elastic deformable material having a Durometer of from about 20 A to about 60 A. This range of Durometer is suitable for moving a relatively viscous fluid such as, for example, skin lotions. The bellows member 220 may be formed from a suitable material including, for example, a thermoplastic polymer, such as polypropylene, thermoplastic polyurethane (TPU), thermoplastic elastomer (TPE), an elastomer such as natural or synthetic rubber, silicone, or other material which will return to its original shape after a force causing deformation is removed. The relative thickness of the bellows member 220 is such that desired strength and elasticity are obtained. For example, suitable thickness for the inner and outer walls 224, 225 of the bellows member 220 may be from less than about 1 mm to over about 10 mm. In one embodiment, a thickness for the walls 224, 225 of the bellows member 220 may be from about 1 mm to about 3 mm for moving a relatively viscous fluid, such as skin lotions. It is understood that other materials for the bellows member 220 may be substituted or interchanged to provide a bellows member 220 having different material characteristics, which may vary depending on the chemistry of the fluid, the fluid viscosity and desired flow rate. The shape, size, dimensions and other specifications of the bellows member 220 may also be altered or modified to generate a desired volume, shape or size in combination with the pressurization chamber 74.

The one-way valve 80 is integral with the tubular projection 228 of the bellows member 220 and, in one embodiment, may be a duckbill valve. The duckbill valve 80 is configured to open in response to positive pressure in the pressurization chamber 74 allowing fluid to pass from the pressurization chamber to the applicator assembly 204. Positive pressure is generated when the bellows member 220 is extended into the pressurization chamber 74 during actuation of the applicator assembly 204 causing the bellows member 220 displaces a volume of fluid through the duckbill valve 80. When pressure is removed, or there is negative pressure in the pressurization chamber 74, the duckbill valve 80 closes preventing fluid backflow, including air, from entering the pressurization chamber 74. It is understood that other one-way valves may be suitable for use in the fluid dispensing apparatus 200, including, but not limited to, ball check valves, swing check valves or tilting disc check valves, stop-check valves, lift-check valves and the like.

Figure 25A:
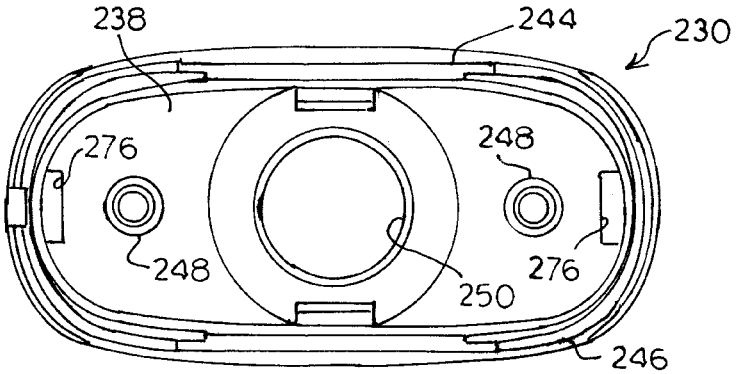
FIG. 25A is a top plan view of an embodiment of a top plate for use in the fluid dispensing apparatus as shown in FIG. 20.
Figure 25B:
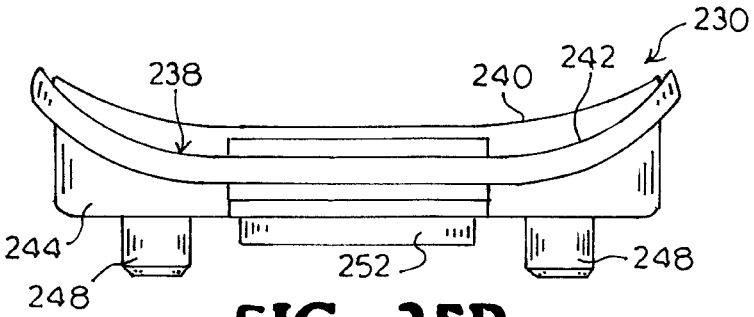
FIG. 25B is a side elevation view of the top plate as shown in FIG. 25A.
Figure 25C:
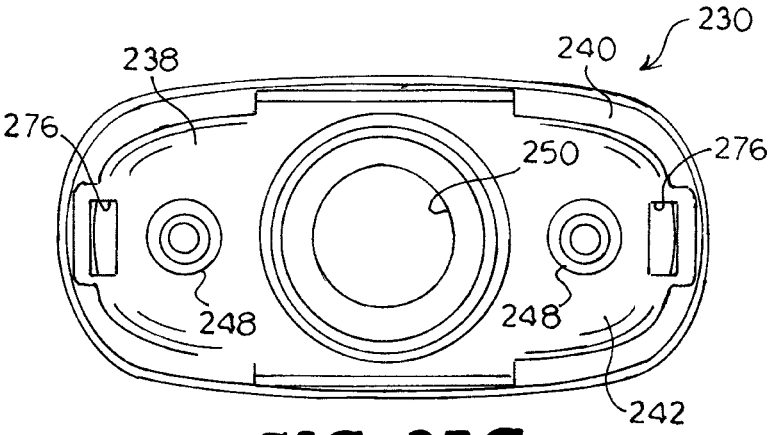
FIG. 25C is a bottom plan view of the top plate as shown in FIG. 25A.

The applicator assembly 204 (FIG. 21) comprises a top plate 230, a fluid upload tray 232 and a roller assembly 234, including a roller 280. Referring to FIGS. 25A-25C, the top plate 230 includes a base member 238 and an integral peripheral wall 240 extending outwardly from the base member 238. The base member 238 and the peripheral wall 240 define a recess in the outer surface 242 of the base member for receiving the upload tray 232. The top plate 230 has a partial peripheral flange 244 extending inwardly from the base member 238. The inner surface of the flange 244 defines a peripheral groove 246 for receiving the outer end of the reservoir assembly 52. The top plate 230 fits snugly onto the housing 58 with the groove 246 in the flange 244 receiving the outer end 64 of the housing. A ledge 245 on opposite sides of the base member 238 snaps past a ledge 294 on the inner surface of the outer end 64 of the housing 58. This arrangement provides a sealing engagement between the applicator assembly 204 and the reservoir assembly 52. The base member 238 of the top plate 230 has a pair of hollow posts 248, each post radially spaced along the central longitudinal axis of the base member 238 equidistant from opposite sides of a central axial bore 250. The posts 248 are sized for being received in the holes 214 of the liner plate 206 for securing the top plate 230 with respect to the liner plate 206. The base member 238 of the top plate 230 also defines a pair of slots 276, each slot along the central longitudinal axis of the base member 238 at the ends of the top plate 230.

Figure 29:
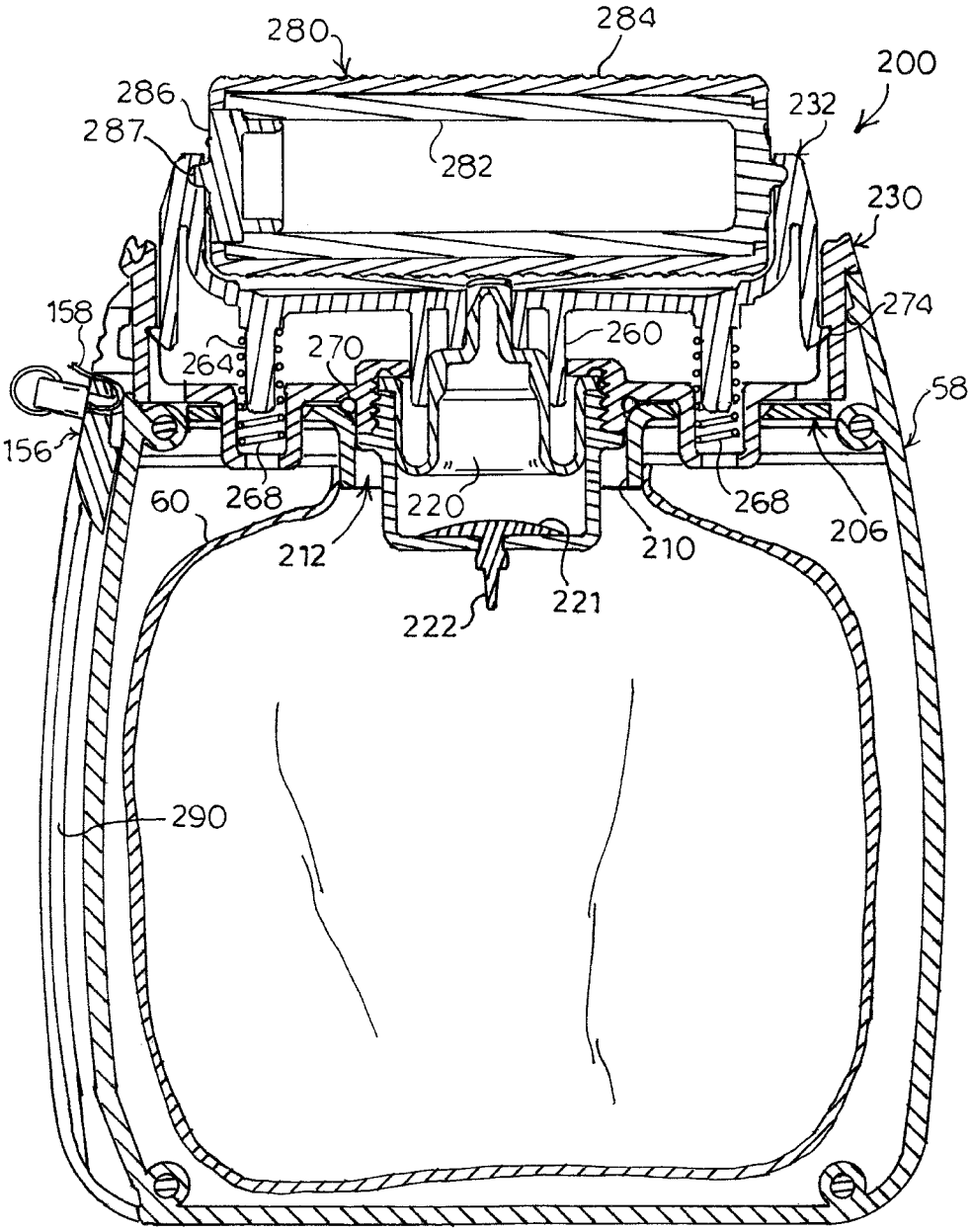
FIG. 29 is a longitudinal cross-section view of the fluid dispensing apparatus as shown in FIG. 20 in a first position.
Figure 31:
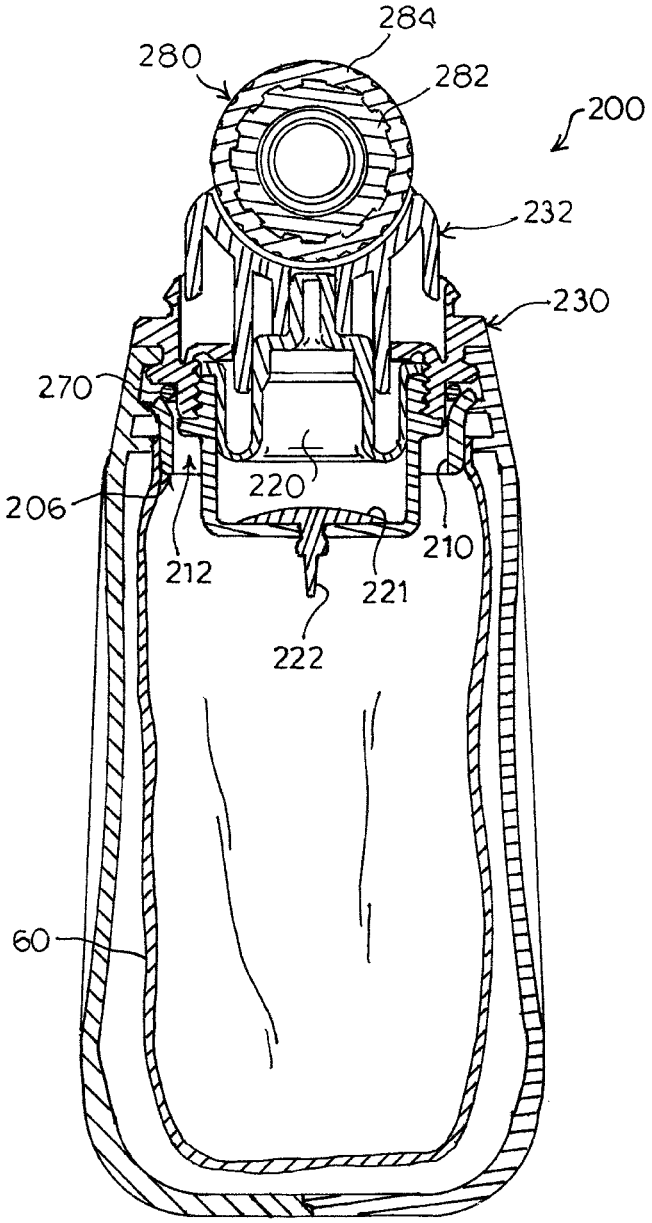

The central axial bore 250 of the base member 238 of the top plate 230 is configured to receive the outer end of the pressurization chamber 74. A portion of the outer end of the pressurization chamber 74 is externally threaded 75 and the bore 250 is internally threaded for removable attachment of the pressurization chamber 74 within the bore 250. As seen in FIGS. 29 and 31, this arrangement captures the peripheral lip 233 of the bellows member 220 between the outer end of the pressurization chamber 74 and a cylindrical flange 252 partially defining the bore 250 of the top plate 230. It is understood that an interference fit or a snap fit of the pressurization chamber 74 into the bore 250 is also suitable. Other alternatives may be used in embodiments for more permanent attachment, including gluing or welding the pressurization chamber 74 in the bore 250. An o-ring 270 is provided for sealing the connection.

Figure 26A:
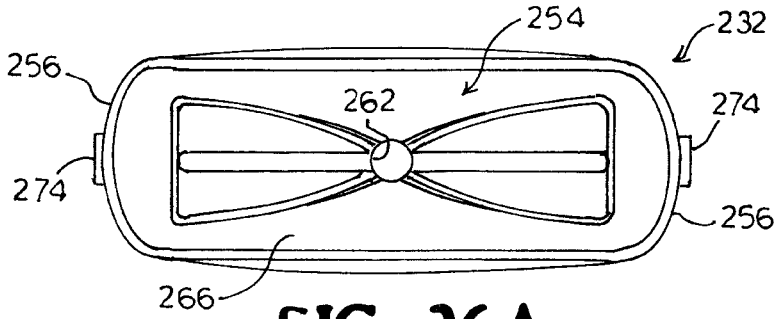
FIG. 26A is a top plan view of an upload tray for use in the fluid dispensing apparatus as shown in FIG. 20.
Figure 26B:
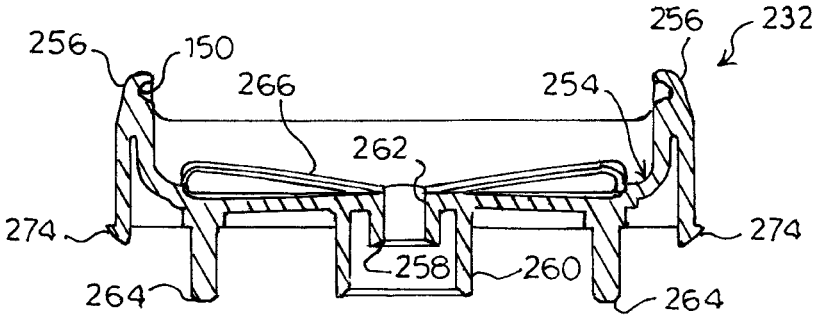
FIG. 26B is a longitudinal cross-section view of the upload tray as shown in FIG. 26A.
Figure 26C:
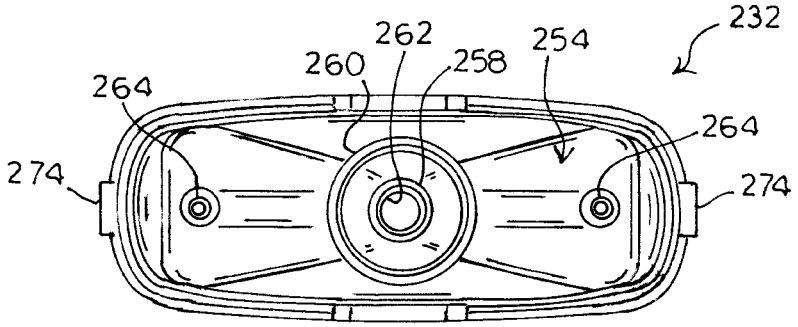
FIG. 26C is a bottom plan view of the upload tray as shown in FIG. 26A.

Referring to FIGS. 26A-26C, the upload tray 232 is configured as a floating bed for reciprocation relative to the top plate 230. The upload tray 232 and is actuated in cooperation with the pump assembly 54 to deliver fluid from the pressurization chamber 74 through the interior of the bellows pump 220 to the upload tray 232. The upload tray 232 comprises a base member 254 including outwardly extending legs at each end. The upload tray 232 has central nested cylindrical flanges 258, 260 extending inwardly from the base member 254. The inner flange 258 defines a central opening 262 through the base member 254. The diameter of the opening 262 corresponds to the diameter of the outer end of the bellows pump 220. The diameter of the outer flange 260 corresponds to the outer diameter of the bellows pump 220. The base member 254 of the upload tray 232 has a pair of posts 264 radially spaced along the central longitudinal axis of the base member 254 from each side of the central opening 262. The base member 254 of the upload tray 232 also has a pair of inwardly extending tabs 274 at the ends of the base member 254.

The legs 256 and the outer surface 266 of the upload tray 232 interconnecting the legs 256 together define a recess for receiving the roller assembly 234. The outer surface 266 of the base member 254 defines a "bow-tie" shaped longitudinal groove 268. The central opening 262 in the base member 254 of the upload tray 232 opens into the midpoint of the groove 268. The shape of the groove 268 facilitates the distribution of fluid along the outer surface 266 of the base member 254 for optimizing uptake onto the roller 280 by presenting a uniform coating of fluid to the roller surface, minimizing uneven distribution of fluid on the roller.

Figure 27A:
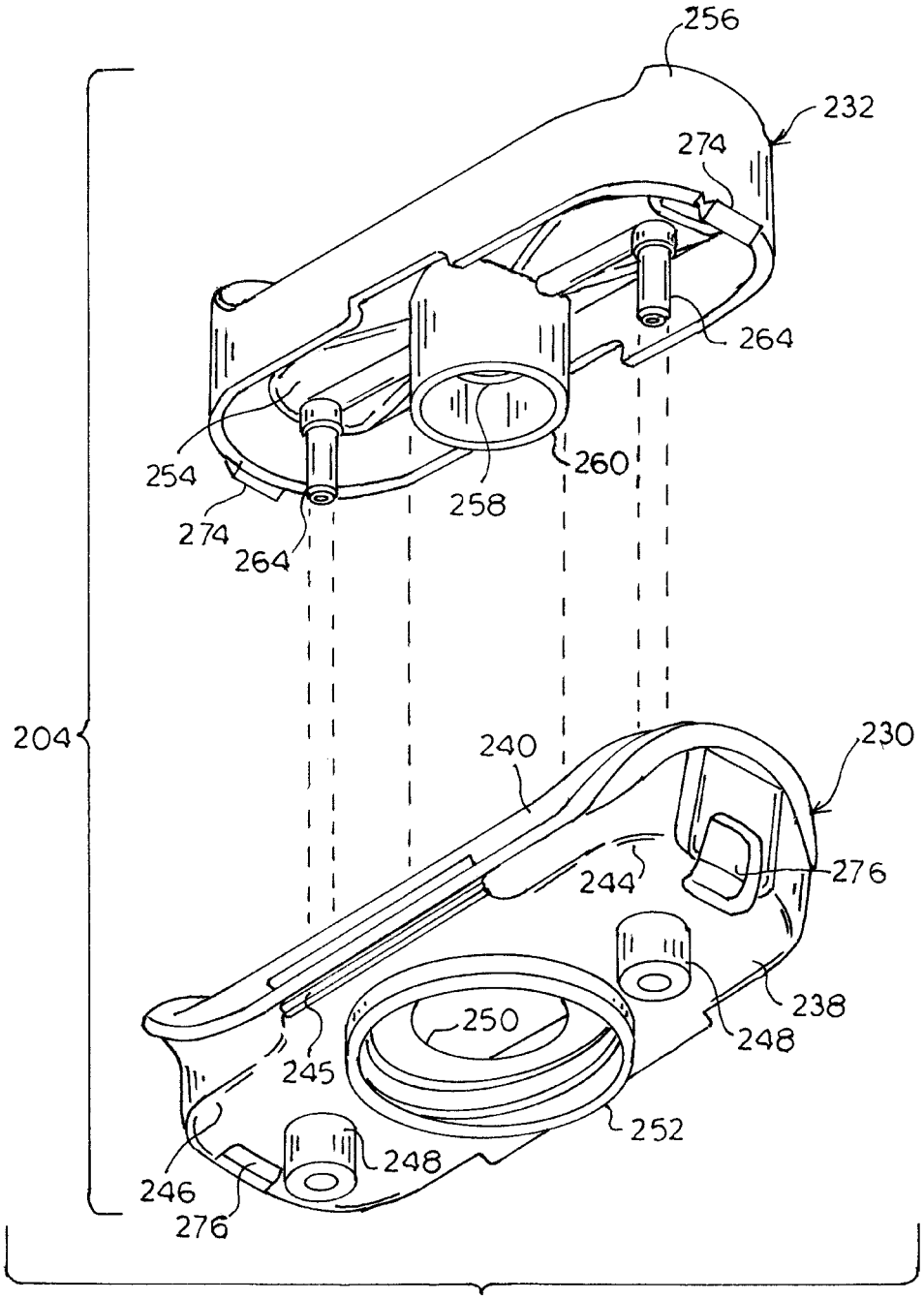
FIG. 27A is an exploded bottom perspective view of the top plate and the upload tray as shown in FIGS. 25A-25C and FIGS. 26A-26C, respectively.
Figure 27B:
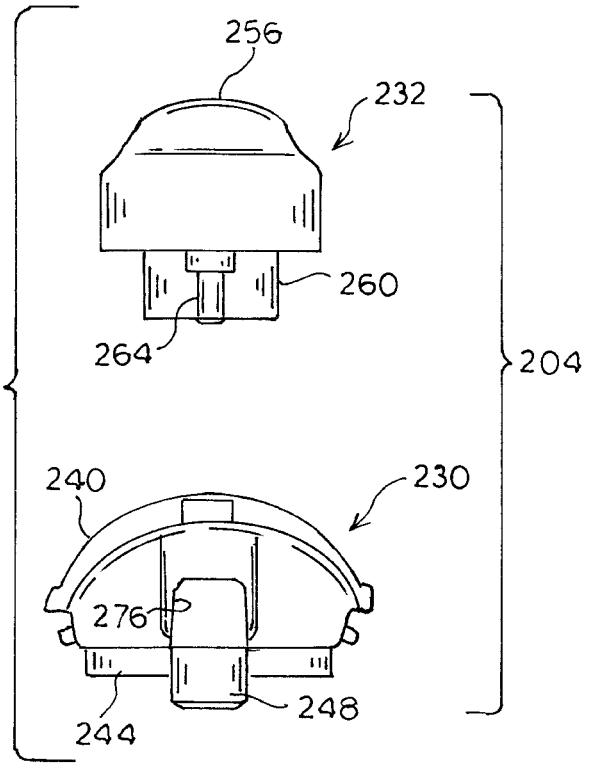
FIG. 27B is an exploded side elevation view of the top plate and the upload tray as shown in FIG. 27A.

As shown in FIGS. 27A and 27B, the upload tray 232 is configured to slidingly fit within the recess of the top plate 230. The posts 264 of the upload tray 232 are sized for being received for reciprocation in the hollow posts 248 of the top plate 230 for reciprocation of the upload tray 232 relative to the top plate 230. The tabs 274 on the base member 254 of the upload tray 232 are configured for being received for reciprocation in the slots 276 of the top plate 230 for providing the limits of reciprocation of the upload tray 232 relative to the top plate 230.

Referring to FIGS. 29 and 31, the bellows member 220 is positioned within the pressurization chamber 74 with the open end of the passage 231 facing inwardly into the pressurization chamber 74. The annular lip 233 of the bellows member 220 rests on the upper edge of the pressurization chamber 74. When the pressurization chamber 74 is threaded into the top plate 230, the lip 233 is compressed against the inner surface of the upload tray 232 of the applicator assembly 204 to seal the annular outer edge of the bellows member 220 between the pressurization chamber 74 and the upload tray 232. In this position, the inner flange 258 of the upload tray 232 encloses the tubular projection 228 of the bellows member 220, including the duckbill valve. The outer flange 260 of the upload tray 232 encloses the inner cylinder 226 of the bellows member 220. The inner surfaces of the inner and outer flanges 258, 260 slidably engage the bellows member 220 so as to permit longitudinal movement of the upload tray 232 into the top plate 230. The outer wall of the bellows member 220 resiliently engages the annular inner surface of the pressurization chamber 74. When assembled, the pressurization chamber 74 and the bellows member 220 together form a sealed variable volume chamber within the pressurization chamber 74 as defined by the shape of the inner surface of the walls of the bellows member 220 and the interior surface of the pressurization chamber 74. In a home position of the bellows member 220, the inner end of the bellows member 220 extends at least partially into the pressurization chamber 74. The bellows pump 220 is sized so that the applicator assembly 204 can reciprocate axially relative to the pressurization chamber 74 and the umbrella valve when the pump assembly 202 is actuated.

In this arrangement, the upload tray 232 is in fluid communication with fluid in the liner 60 via the bellows pump 220. The bellows member is selectively actuated in order to discharge fluid contents from the liner, through the pressurization chamber, and out of the bellows via the duckbill valve, thereby delivering the fluid to the upload tray 232. Actuation of the bellows member 220 extends the bellows member 220 longitudinally into the pressurization chamber 74 and expels fluid via the duckbill valve 80. Releasing the bellows member 220 to return to the original position draws fluid into the pump chamber. The upload tray 232 is biased outwardly toward a home position by means of coil springs 268 disposed in the posts 248 of the top plate 230 and receiving the posts 264 of the upload tray 232. It is understood that other loading springs may be suitable for the fluid dispensing apparatus 200, such as a leaf spring, volute springs, or torsion springs.

Figure 28A:
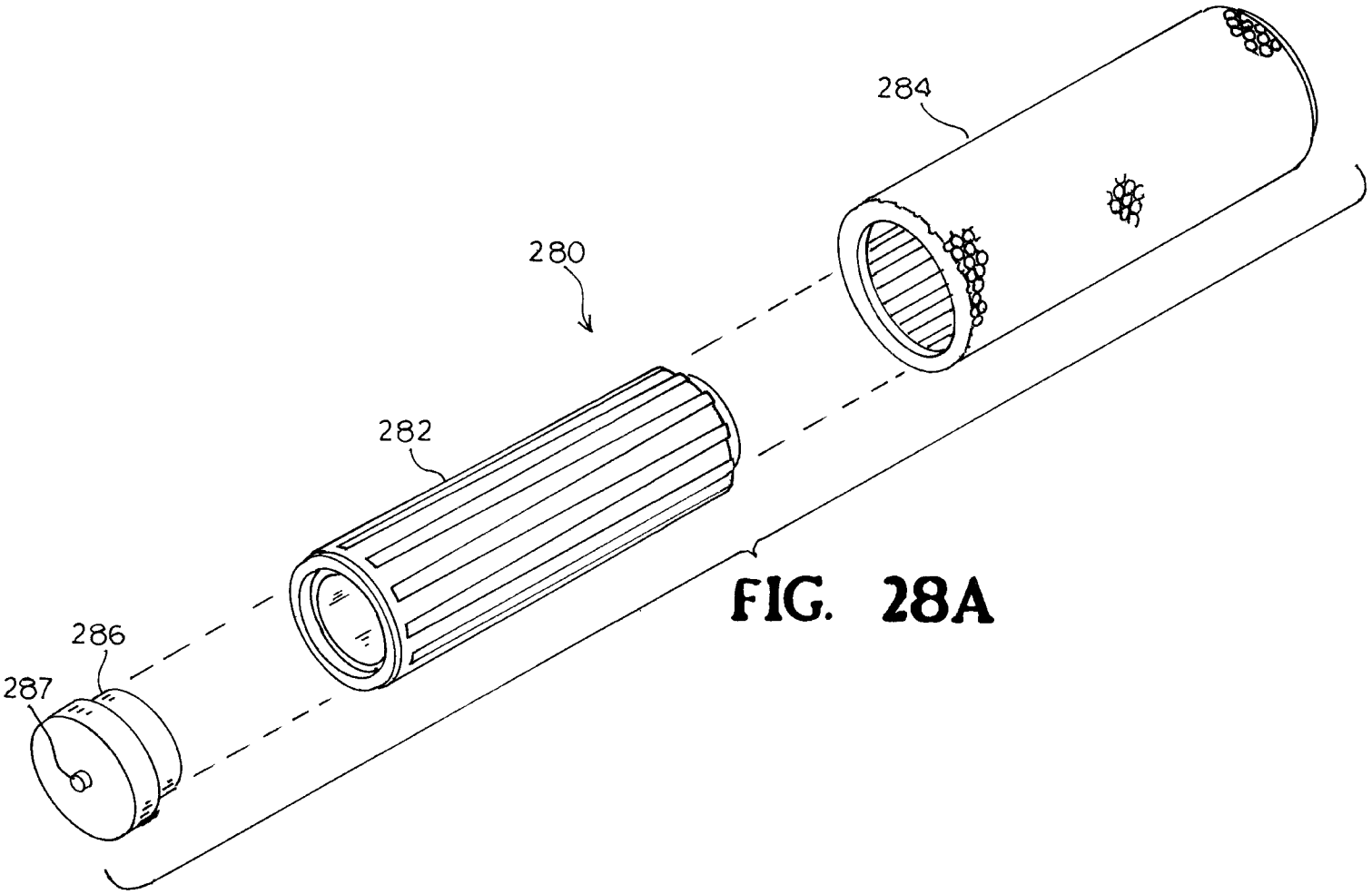
FIG. 28A is an exploded perspective view of a roller assembly for use in the fluid dispensing apparatus as shown in FIG. 20.
Figure 28C:
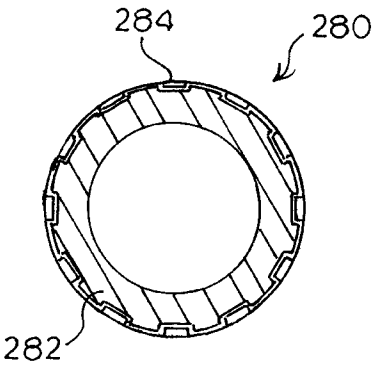
FIG. 28C is a transverse cross-section view of the roller assembly as shown in FIG. 28B.
Figure 28B:
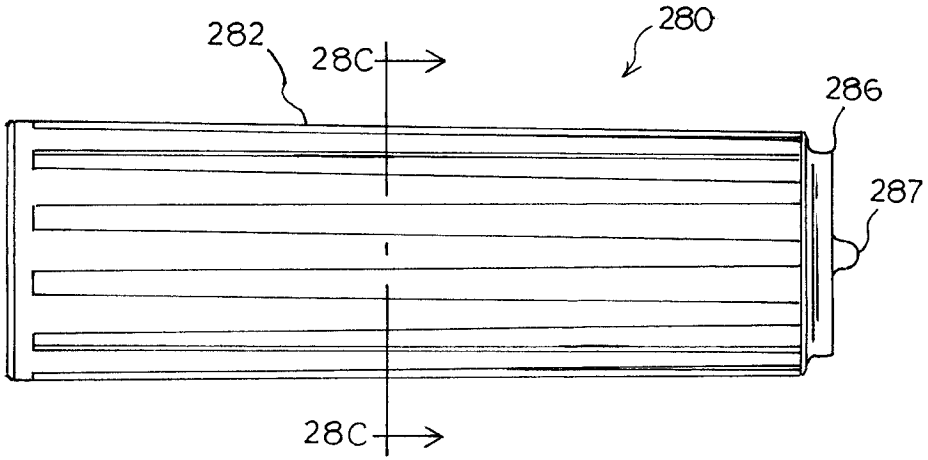
FIG. 28B is an elevation view of the roller assembly as shown in FIG. 28B.

As shown in FIGS. 28A-28C, the roller 280 comprises an elongated cylindrical rigid core 282 and an outer tubular sleeve 284. The roller sleeve 284 is flexible and configured to fit over the roller core 282. The roller sleeve 284 has a textured surface provided by a regular pattern of grooves and projections. The material of the roller sleeve may be non-porous and pliable for contacting the skin. Preferably, the material of the roller sleeve is silicone.

The roller 280 includes hubs 286 at each end of the roller core 282. The hubs 286 include central projections 287 received in corresponding opposed apertures in the end walls 256 of the upload tray 232. This arrangement allows for rotatable attachment of the roller 280 in the recess of the upload tray 232. The end walls 256 of the upload tray 232 or the roller 280 may be sufficiently resilient to allow deformation so that the axle projections 287 engage or disengage with the upload tray 232.

The upload tray 232 and the roller 280 are movable together relative to the housing 58 so as to be capable of being depressed inwardly against the bias of the springs 268 as a consequence of the user pressing the roller 280 inward, for example, against the skin. This actuates the pump assembly 202 for supplying fluid with the roller 280 in rolling contact with the skin for dispensing fluid onto the skin. With this arrangement, the user is only required to bring the roller 280 into contact with the skin and apply pressure to actuate the pump assembly 202 for transferring the fluid to the upload tray 232 each time the applicator assembly 204 is depressed. The applicator assembly 204 performs the dual function of both actuating the pump assembly 202 while also dispersing the fluid in a controlled manner necessary to achieve the uniform coverage desirable in some applications.

In use, referring to FIGS. 29 and 31, the user grasps the housing 58 and places the roller 280 in contact with an area of skin to be covered with fluid. The user then presses the roller 280 against the skin. The pressure applied on the roller 280 forces the connected upload tray 232 inwardly into the recess defined by the wall 240 of the top plate 230 and against the force of the springs 268. As the upload tray 232 moves inwardly, the bellows member 220 connected to the upload tray 232 is extended inwardly into the pressurization chamber 74. The springs 268 in the posts 248 of the top plate 230 are compressed by the pins 264 of the upload tray 232. Because the bellows member 220 is elastic and resilient, inward extension of the bellows member 220 also loads the bellow member 220 thereby storing energy for moving the applicator assembly 204 outwardly.

As the bellows member 220 extends inwardly toward the inner wall of the pressurization chamber 74, the bellows member 220 expands lengthwise forcing the outer wall 225 of the bellows member 220 to bulge radially for continuously resiliently engaging the inner surface of the pressurization chamber 74 providing an annular seal. During eversion of the bellows member 220, the inner flange 258 and the outer flange 260 of the upload tray 232 support the tubular projection 228 and the inner cylinder 226 as the bellows member 220 lengthens. The depth of the inner cylinder 226 is reduced and the depth of the outer cylinder 227 is increased such that the volume of the variable volume chamber 82 is reduced, generating positive pressure within the chamber 82. The increased pressure urges the umbrella valve 221 against the bottom wall of the pressurization chamber 74 to prevent fluid in the chamber from being forced back into the liner 60 via the holes 88. At a predetermined threshold, the pressure in the chamber 82 is sufficient to open the duckbill valve 80 at the outer end of the bellows member 220. The fluid within the chamber is forced up through the tubular projection and out the duckbill valve 80 passing through the opening 262 in the top plate 230 and onto the outer surface 266 of the upload tray 232. The configuration of the bellows member maximizes the area of the fluid flow path exiting the chamber. The fluid is distributed laterally from the opening 262 along the channel in the upload tray 232 between the outer surface 266 of the upload tray 232 and the roller 280. When the user moves the roller 280 along the skin, the roller rotates. The rotating roller 280 picks up the fluid and draws the fluid past the edge of the side walls of the upload tray 232 where the fluid is screened to a uniform layer on the roller 280 that is then delivered to the skin as the roller 280 continues to rotate further until breaking contact with the skin. The roller 280 provides rapid uniform delivery of fluid over the skin.

Figure 30:
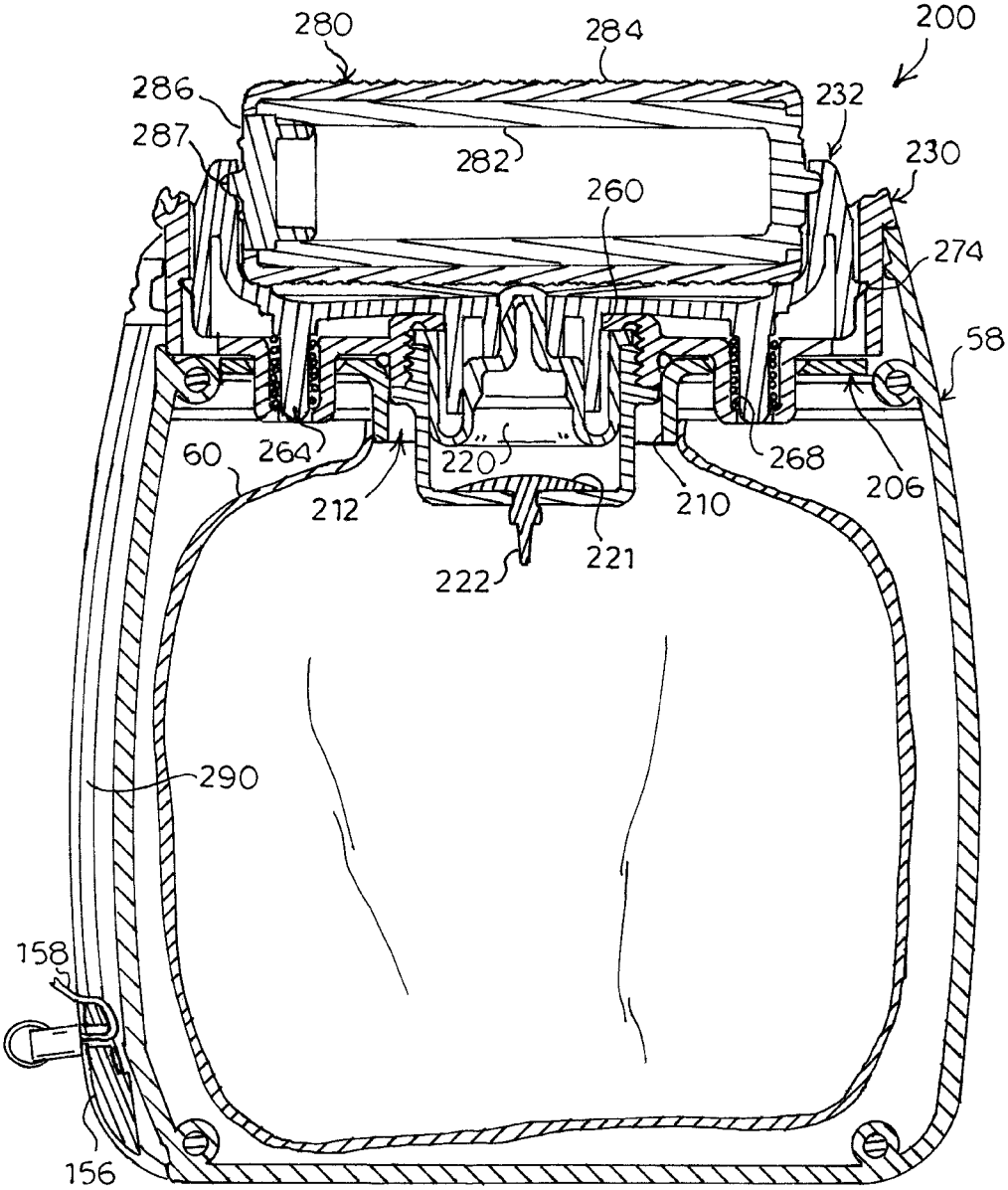
FIG. 30 is a longitudinal cross-section of the fluid dispensing apparatus as shown in FIG. 29 in a second position.
Figure 32:
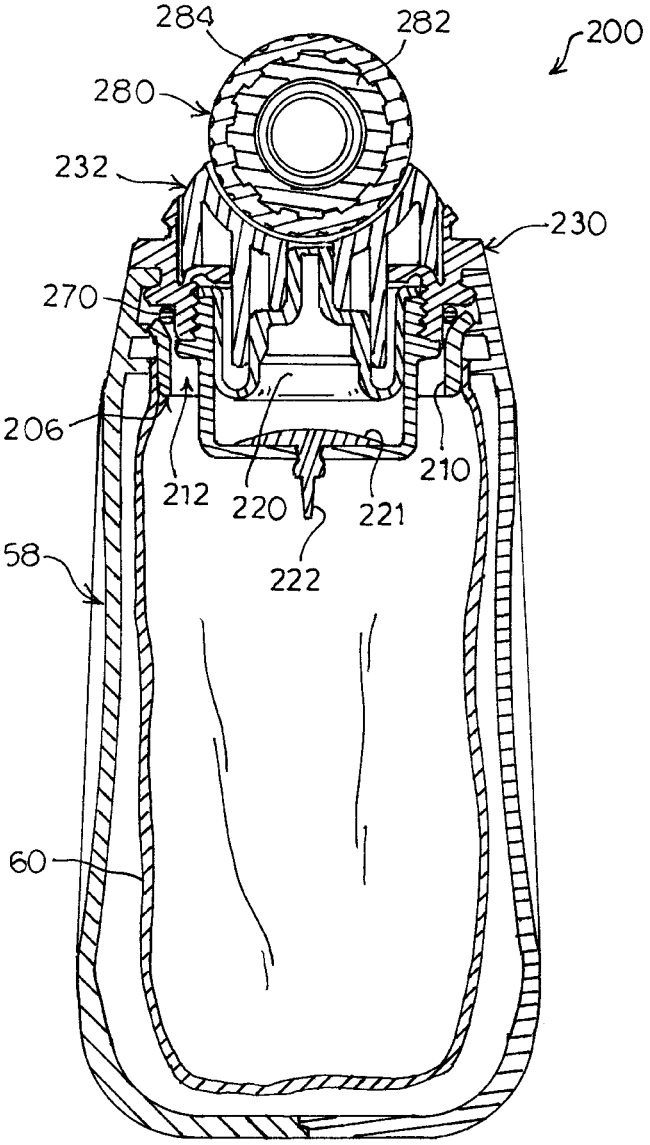

The upload tray 232 retains unused fluid beneath the roller 280 to reduce leakage that may otherwise result from excess fluid accumulating on the exposed surface of the applicator assembly 204. Unused fluid is held in the upload tray 232 awaiting transfer to the roller 280 during rotation. As shown in FIGS. 30 and 32, the edges of the side walls of the upload tray 232 are adjacent the roller 280. The side walls screen excess fluid from the rotating roller 280 when passing through a clearance between the side walls and the roller prior to dispensing fluid over the skin. The close fit of the roller 280 in the recess of the upload tray 232 helps provide a more uniform fluid coating on the roller 280 and reduces fluid buildup on the edges of the upload tray 232. With this arrangement, fluid application to the skin is more efficient and reduces repetitive passage on the skin to place a uniform layer of fluid.

When sufficient pressure on the roller 280 is released, though the roller 280 is not necessarily out of contact with the skin, the springs 268 return the upload tray 232 to the home position (FIGS. 29 and 31) against the inner surface of top plate 230, the most outward position. The bellows member 220 may return to its original shape, the elasticity of the bellows member forcing the stem outwardly until the bellows member 220 is restored to its original rest position. The inherent resilience of the bellows member 220 causes the bellows member to recoil, providing additional outward force for the return of the upload tray 232 to the home position. It is understood that the fluid dispensing apparatus 200 need not include the springs 268 so that the bellows member 220 provides all of the force necessary to return the upload tray 232 to its home position relative to the top plate 230.

Outward movement of the bellows member 220 increases the volume of the chamber 82 and generates a vacuum or negative pressure within the pressurization chamber 74. Due to the vacuum or negative pressure, the duckbill valve 80 closes stopping outward fluid flow and preventing fluid and air from flowing back through the bellows member 220. The vacuum or negative pressure further causes the umbrella valve 221 to deform or at least partially deflect inwardly along its circumference away from contact with the bottom wall. The vacuum or negative pressure draws fluid from the liner 60 into the chamber 82 through the intake ports 88 in the bottom wall of the pressurization chamber 74. In this manner, the chamber is primed or at least partially refilled with fluid to be dispensed during the next stroke. The flexible liner 60 is deformable, and the liner contracts as fluid is drawn into the pressurization chamber 74. Air does not enter the liner 60, which enables inverted operation and eliminates the need to shake fluid into position to be taken up into the pressurization chamber 74 via the intake ports 88. One or more vent holes may be provided in the housing 58 to enable the liner 60 to more easily contract. When the upload tray reaches the home position and the bellows member 220 has returned to its original shape and position, or when the vacuum force is insufficient to deflect the umbrella valve 221, the umbrella valve again contacts the bottom wall of the pressurization chamber. This contact stops the flow of fluid through the inlet holes 88 into the chamber 82.

Figure 33A:
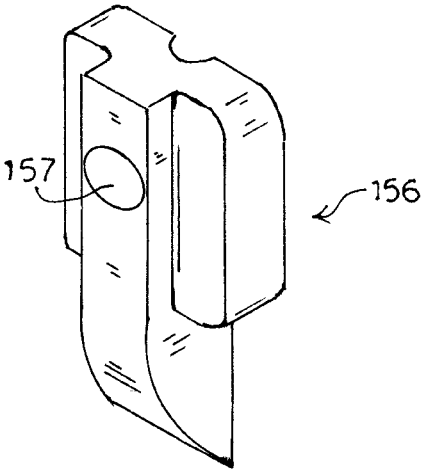
FIGS. 33A-33C are a front perspective view, rear perspective view and a longitudinal cross-section view, respectively, of a sliding clip for a lanyard for use in the fluid dispensing apparatus as shown in FIG. 20.
Figure 33B:
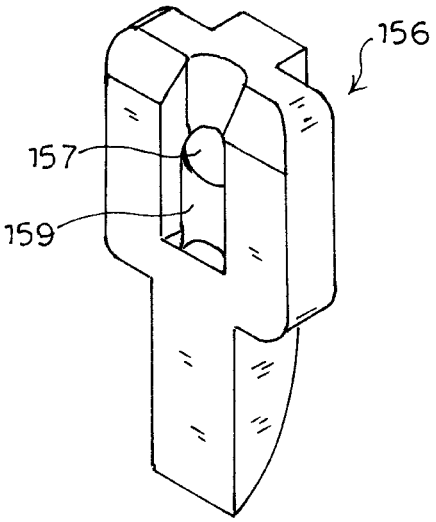
Figure 33C:
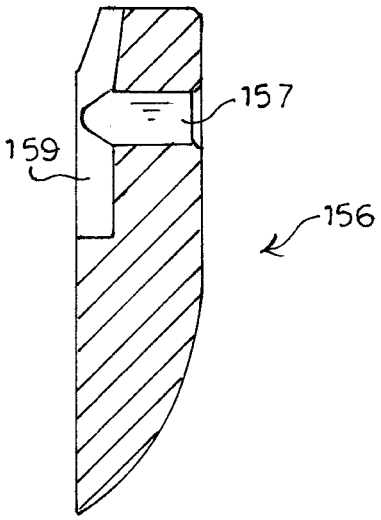

FIGS. 29 and 30 also show two extreme positions of a clip 156 in the slot 290 of the housing 58 for carrying a lanyard 158 connected to the cap 154. The clip 156 is shown in detail in FIGS. 33A-33C. The clip 156 is slidable in the slot 290 from one end of the housing 58 to the other, thereby allowing the lanyard 158 to be relatively short while allowing the cap 154 to be placed by the user either over the applicator assembly 204 or on the housing 58 opposite the applicator assembly. In this configuration, the cap 154 remains attached to the housing 58 while enabling the user to move the cap 154 to a position that does not interfere with the applicator assembly during use.

While various embodiments of the fluid dispensing apparatus have been described with respect to pump and applicator assemblies for fluid delivery to the skin, such as for use in the personal and beauty care products, it is understood that the pump and applicator assemblies of the various embodiments may be used in other fields or markets. Such pump and applicator assemblies may be scaled up or down as desired to meet desired specifications for fluid delivery to other surfaces. The pump and applicator assemblies may be used to deliver product from a container to the surface. In some instances, the container is a bottle and in other instances, the container may be a bag, a pouch, or a tube. Further, the pump assemblies of the various embodiments are in communication with the container and evacuate fluid from the container for delivery to the applicator assembly. It is understood that a container may include any receptacle which may be used to hold a product, including, but not limited to, bottles, bags, pouches, sachets, airless systems, tubes and other devices.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, an extension arm can be added as a fixed or detachable element to enable a longer reach of the fluid dispensing apparatus to desired application targets, such as the back. Moreover, the fluid dispensing apparatus can be made to dispense any fluid, such as paints, oils, and the like. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An apparatus for dispensing a fluid on a surface, the fluid dispensing apparatus comprising:

a housing defining an interior;

a resilient liner adapted to hold the fluid, the liner configured to be at least partially disposed in the interior of the housing;

an applicator assembly for dispensing the fluid on the surface, the applicator assembly mounted on the housing, the applicator assembly including:

an actuator movable relative to the housing in a first direction and a second direction, the actuator comprising a tray member having at least one elongated aperture in fluid communication with the liner for temporarily storing the fluid supplied from the liner, the tray member including a pair of spaced side walls, each side wall having a tapered outer surface that tapers toward the inner edge of the spaced wall, and a pair of opposed end walls formed integrally with the side walls, a roller rotatably mounted to the end walls of the tray member such that the aperture extends along the longitudinal axis of the roller for communicating fluid to the roller, the roller adapted to be held in contact against the surface for applying the fluid onto the surface, the roller supported on the end walls of the tray member to be movable together with the actuator by varying contact pressure with the surface; and a pump assembly at least partially disposed in the housing, the pump assembly comprising:

a pump chamber having an inner surface defining an interior cavity for accommodating fluid, the pump chamber configured to be in fluid communication with the liner and having at least one inlet opening for receiving the fluid, and a bellows member defining an opening therethrough in fluid communication with the applicator assembly, the bellows member operatively engaging the actuator of the applicator assembly and disposed in the pump chamber for extension in the first direction and contraction in the second direction, the bellows member sealing against the inner surface of the pump chamber during extension and contraction and defining a variable volume chamber with the pump chamber, and a valve at an outlet end of the opening through the bellows member, wherein each movement of the actuator in the first direction reduces the volume of the variable volume chamber for generating positive pressure in the pump chamber and forcing fluid through the valve and to the tray member of the applicator assembly for dispensing the fluid, and each movement of the actuator in the second direction increases the volume of the variable volume chamber and generates negative pressure within the pump chamber for drawing fluid through the at least one inlet opening into the pump chamber.

2. The fluid dispensing apparatus as recited in claim 1, further comprising a valve disposed in a fluid flow path from the liner to the pump chamber, wherein the valve opens only when the actuator moves in the second direction for allowing fluid flow from the liner to the pump chamber.

3. The fluid dispensing apparatus as recited in claim 1, wherein the valve at the outlet end of the opening through the bellows member opens only when the actuator moves in the first direction.

4. The fluid dispensing apparatus as recited in claim 3, wherein the valve comprises a duckbill valve for permitting fluid flow through the valve only in response to pressurizing of fluid upstream of the valve such as by moving the actuator in the first direction.

5. The fluid dispensing apparatus as recited in claim 1, wherein the at least one opening comprises a plurality of fluid receiving ports in a generally radial array, the ports opening into the pump chamber.

6. The fluid dispensing apparatus as recited in claim 5, wherein the fluid receiving ports are positioned symmetrically about a central axial opening through said pump chamber.

7. The fluid dispensing apparatus as recited in claim 1, wherein the applicator assembly is removably mounted to the housing.

8. The fluid dispensing apparatus as recited in claim 1, wherein the roller is made of an elastic material.

9. The fluid dispensing apparatus as recited in claim 1, wherein the housing has an exposed compressible surface for delivering the fluid disposed within the housing to the applicator assembly by manually squeezing the housing.

* * * * *